US012313382B2

(12) United States Patent
Horner

(10) Patent No.: US 12,313,382 B2
(45) Date of Patent: May 27, 2025

(54) BALLISTIC RESISTANT WALL STRUCTURES

(71) Applicant: SAFEWOOD DESIGNS, INC., Fridley, MN (US)

(72) Inventor: Jason Horner, Forest Lake, MN (US)

(73) Assignee: SAFEWOOD DESIGNS, INC., Fridley, MN (US)

( * ) Notice: Subject to any disclaimer, the term of this patent is extended or adjusted under 35 U.S.C. 154(b) by 147 days.

(21) Appl. No.: 17/899,438

(22) Filed: Aug. 30, 2022

(65) Prior Publication Data

US 2023/0003487 A1 Jan. 5, 2023

Related U.S. Application Data

(63) Continuation of application No. PCT/US2021/024976, filed on Mar. 30, 2021.

(60) Provisional application No. 63/002,188, filed on Mar. 30, 2020.

(51) Int. Cl.
*F41H 5/013* (2006.01)
*F41H 5/24* (2006.01)

(52) U.S. Cl.
CPC ..... *F41H 5/013* (2013.01); *F41H 5/24* (2013.01)

(58) Field of Classification Search
CPC ..... E06B 5/10; F41H 5/013; F41H 5/24
See application file for complete search history.

(56) References Cited

U.S. PATENT DOCUMENTS 3,924,038 A 12/1975 McArdle et al.
4,470,357 A 9/1984 Sanzaro
4,567,100 A 1/1986 Pickett et al.
5,469,796 A 11/1995 Koenig
6,058,655 A * 5/2000 Gravel ..... B60P 7/14 49/306
6,327,954 B1 12/2001 Medlin
6,708,595 B1 3/2004 Chaussade et al.
(Continued)

FOREIGN PATENT DOCUMENTS

CN 200992924 Y 12/2007
CN 104563799 A 4/2015
(Continued)

OTHER PUBLICATIONS

"Aaron Carlson Ballistics Architectural Woodwork," ACC Ballistics Brochure, pp. 1-8, Nov. 2016.
(Continued)

*Primary Examiner* — Joshua E Freeman
(74) *Attorney, Agent, or Firm* — Seager, Tufte & Wickhem LLP

(57) ABSTRACT

Building components and building systems and methods of using are disclosed. An example building component may include a ballistic resistant panel system. The ballistic resistant panel system may include a panel and a mount connected to the panel. The mount may be configured to secure the panel with respect to a wall system or structure and may facilitate selective movement of the panel relative to the wall system. The panel may include a ballistic resistant layer and an outer layer secured to a least one side of the ballistic resistant layer. The ballistic resistant layer may include one or more panels of ballistic resistant material. The outer layer may be decorative or functional layer.

19 Claims, 25 Drawing Sheets

(56) References Cited

U.S. PATENT DOCUMENTS

| | | | | |
|---|---|---|---|---|
| 7,908,958 | B2 | 3/2011 | Mandelartz et al. | |
| 8,011,146 | B2 | 9/2011 | Krause | |
| 8,245,619 | B2 | 8/2012 | Hall | |
| 8,336,260 | B1 * | 12/2012 | Mandall | E06B 5/12 52/64 |
| 8,850,949 | B1 * | 10/2014 | Lopez | F41H 5/24 89/36.02 |
| 8,991,118 | B2 * | 3/2015 | Tunis, III | F41H 5/226 52/203 |
| 9,200,480 | B2 | 12/2015 | Deiler | |
| 9,212,482 | B2 | 12/2015 | Frederick | |
| 9,310,170 | B1 | 4/2016 | Basewitz | |
| 9,316,467 | B2 * | 4/2016 | Tunis, III | F41H 5/0471 |
| 9,976,306 | B1 | 5/2018 | Horner | |
| 10,060,181 | B1 * | 8/2018 | Jones, Jr. | E06B 7/28 |
| 10,125,486 | B1 * | 11/2018 | Handley | F41H 5/18 |
| 10,125,528 | B2 * | 11/2018 | Wypych | E05D 15/0652 |
| 10,151,566 | B2 | 12/2018 | Adrain | |
| 2004/0163571 | A1 | 8/2004 | Fortin | |
| 2006/0230684 | A1 * | 10/2006 | Poole | E05D 15/0634 49/409 |
| 2007/0151165 | A1 * | 7/2007 | Brendel | E06B 7/23 49/467 |
| 2007/0175121 | A1 * | 8/2007 | Speyer | E06B 3/46 52/207 |
| 2008/0092731 | A1 | 4/2008 | Hall | |
| 2009/0044695 | A1 | 2/2009 | Benjamin et al. | |
| 2010/0297388 | A1 | 11/2010 | Dagher et al. | |
| 2011/0048292 | A1 * | 3/2011 | Zimmer, II | E05G 1/026 89/36.01 |
| 2011/0239851 | A1 | 10/2011 | Mason et al. | |
| 2012/0011789 | A1 * | 1/2012 | Henriott | E06B 3/46 52/239 |
| 2012/0060436 | A1 | 3/2012 | Zimmer, II | |
| 2012/0167371 | A1 | 7/2012 | Mateu Climent | |
| 2014/0000194 | A1 | 1/2014 | Daniels et al. | |
| 2014/0013934 | A1 | 1/2014 | Inglefield et al. | |
| 2014/0208993 | A1 * | 7/2014 | Spransy | E05B 65/0888 109/73 |
| 2014/0360344 | A1 | 12/2014 | Pilpel et al. | |
| 2014/0360416 | A1 * | 12/2014 | Deiler | F41H 5/0457 109/64 |
| 2015/0096479 | A1 * | 4/2015 | McCarthy | A47F 9/00 89/36.02 |
| 2015/0143986 | A1 | 5/2015 | Tunis, III | |
| 2015/0292841 | A1 * | 10/2015 | Fultz | E06B 3/68 89/36.04 |
| 2015/0362294 | A1 | 12/2015 | Spransy | |
| 2016/0178329 | A1 | 6/2016 | Gibson | |
| 2016/0281416 | A1 * | 9/2016 | Spransy | F41H 5/013 |
| 2019/0063878 | A1 | 2/2019 | Mowbray et al. | |
| 2019/0360782 | A1 * | 11/2019 | Blackburn | G08B 5/36 |
| 2020/0018572 | A1 * | 1/2020 | Gonzales | F41H 5/24 |
| 2020/0072580 | A1 * | 3/2020 | Deering | F41H 5/24 |
| 2020/0232271 | A1 * | 7/2020 | Ramachandran | E06B 5/11 |
| 2020/0309488 | A1 * | 10/2020 | Batiste | E05C 19/166 |
| 2021/0271894 | A1 * | 9/2021 | Polinski | B05B 1/02 |
| 2022/0290487 | A1 * | 9/2022 | Martin | G08B 13/08 |

FOREIGN PATENT DOCUMENTS

| | | | |
|---|---|---|---|
| CN | 105332617 | A | 2/2016 |
| EP | 2133650 | A2 | 12/2009 |
| GB | 2050941 | A | 1/1981 |
| GB | 2258488 | A | 2/1993 |
| WO | 03038224 | A1 | 5/2003 |
| WO | 2018026602 | A1 | 2/2018 |

OTHER PUBLICATIONS

"Lloyd Doors Combined Set," Engineering Drawings for an Installed Door, Aaron Carlson Corp, pp. 1-6, 2014.

Revised Lloyd Doors Sheet 4, Engineering Drawings for an Installed Door, Aaron Carlson Corp, pp. 1-1, 2014.

* cited by examiner 14
23
88
90
2
10
15
34
74
76
92
94
96
98
A
D

BALLISTIC RESISTANT WALL STRUCTURES

CROSS REFERENCE TO RELATED APPLICATIONS

This application is a continuation of International Application No. PCT/US2021/024976, filed Mar. 30, 2021, which claims priority to U.S. Patent Application Ser. No. 63/002,188, filed Mar. 30, 2020, the disclosure of which are incorporated herein by reference.

TECHNICAL FIELD

The present disclosure pertains to wall structures, and methods for manufacturing and using wall structures. More particularly, the present disclosure pertains to movable ballistic resistant wall structures including ballistic resistant wall panels, shutter panels, slider panels, door panels, etc.

BACKGROUND

A wide variety of wall structures have been developed for various uses in various types of building structures. Some of these wall structures may include ballistic resistant doors and wall panels used to restrict penetration of bullets and/or shrapnel through the wall structure. These structures are manufactured by any one of a variety of different manufacturing methods and may be used according to any one of a variety of methods. Of the known wall structures and methods, each has certain advantages and disadvantages.

SUMMARY

This disclosure provides design, material, manufacturing method, and use alternatives for building components.

A first example is a ballistic resistant panel system. The ballistic resistant panel system includes a panel and a mount. The panel includes a ballistic resistant layer and an outer layer secured to at least one side of the ballistic resistant layer. The mount is connected to the panel and configured to secure the panel with respect to a wall system and facilitate selective movement of the panel relative to the wall system.

Alternatively or additionally to any of the examples above, a lock is secured to the panel and configured to lock the panel at a location relative to the wall system.

Alternatively or additionally to any of the examples above, one or more wheels are secured to the panel to facilitate the movement of the panel relative to the wall system.

Alternatively or additionally to any of the examples above, the mount includes one or more hinge secured to the panel and securable to the wall system.

Alternatively or additionally to any of the examples above, one or more slide systems are secured to the panel and configured to facilitate the movement of the panel relative to the wall system.

Alternatively or additionally to any of the examples above, the panel includes a first sub-panel and a second sub-panel. The ballistic resistant layer is a first ballistic resistant layer of the first sub-panel and the outer layer is a first outer layer of the first sub-panel. The second sub-panel includes a second ballistic resistant layer of a second sub-panel and a second outer layer of the second sub-panel, the second outer layer is secured to the second ballistic resistant layer.

Alternatively or additionally to any of the examples above, the second sub-panel is movable with respect to the first sub-panel, and the first sub-panel and the second sub-panel are movable with respect to the wall system.

Alternatively or additionally to any of the examples above, a slide system is connected to the first sub-panel and the second sub-panel, the slide system is configured to facilitate movement between the first sub-panel and the second sub-panel.

Alternatively or additionally to any of the examples above, a housing configured to at least partially house the panel when the panel is in a closed position.

Alternatively or additionally to any of the examples above, the movement is one or both of rotational movement and linear movement.

Alternatively or additionally to any of the examples above, the ballistic resistant layer comprises two or more ballistic resistant panels secured relative to one another.

A further example is a ballistic resistant panel system. The ballistic resistant panel system includes a panel and a housing. The panel includes a ballistic resistant layer and an outer layer secured to at least one side of the ballistic resistant layer. The panel is movable relative to the housing from a closed position to an opened position.

Alternatively or additionally to any of the examples above, a handle secured relative to the panel. The panel is movable from the closed position to the opened position in response to a force applied to the handle, the force is at least partially in a direction of the movement.

Alternatively or additionally to any of the examples above, an end panel is secured relative to the panel and having a width that is perpendicular to a width of the panel.

Alternatively or additionally to any of the examples above, a handle secured to the end panel.

Alternatively or additionally to any of the examples above, the panel is a pocket door and the housing includes an end panel secured to the panel.

Alternatively or additionally to any of the examples above, the housing includes a backer layer between the panel and a wall of a wall system, and the outer layer includes one or both of a functional portion and a decorative portion.

A further example is a method of securing an opening in a wall system. The method includes identifying an attacker risk at one or more locations along a wall system, and adjusting a position of a ballistic resistant panel from a non-securing position spaced from the one or more locations along the wall system to a securing position covering the one or more locations along the wall system.

Alternatively or additionally to any of the examples above, locking the ballistic resistant panel in the securing position.

Alternatively or additionally to any of the examples above, interacting with an outer surface of the ballistic resistant panel when the ballistic resistant panel is in the non-securing position.

The above summary of some embodiments, aspects, and/or examples is not intended to describe each embodiment or every implementation of the present disclosure. The figures and the detailed description which follows more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
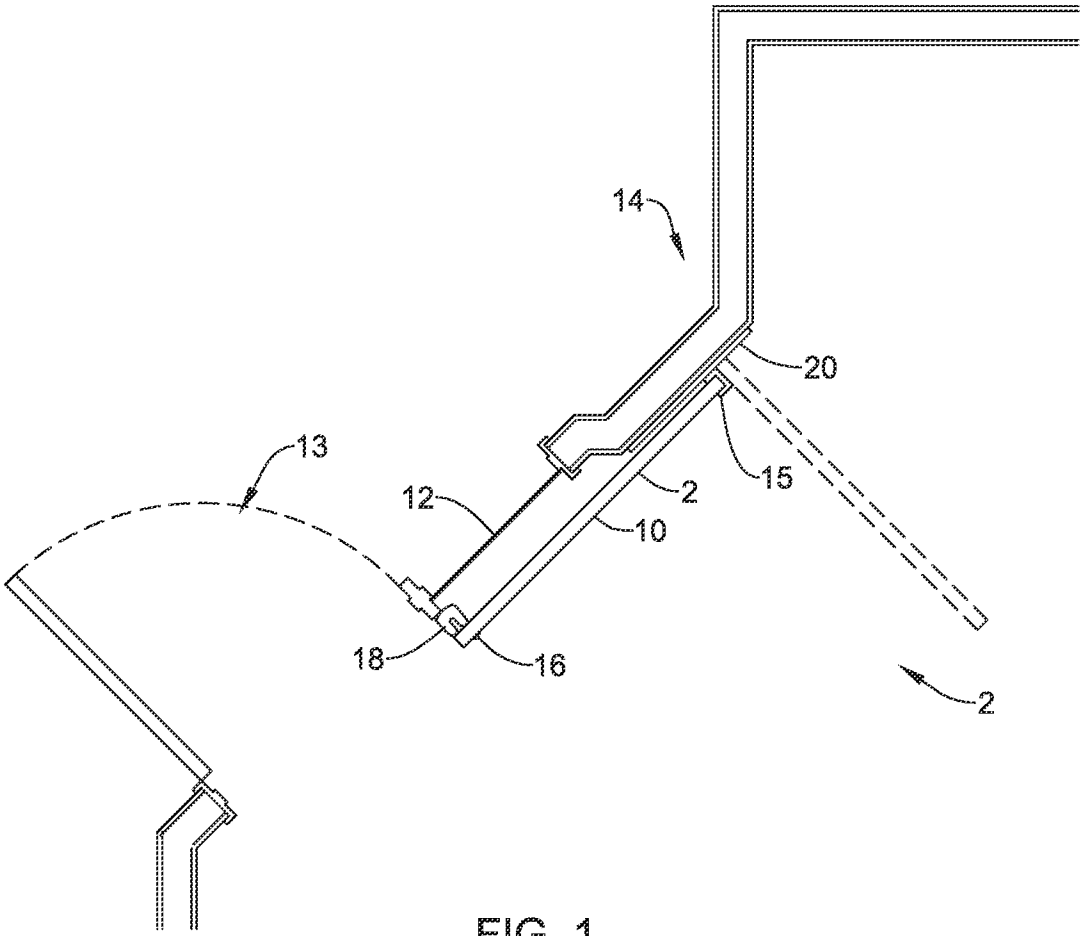
FIG. 1 is a schematic plan view of an illustrative ballistic resistant panel system in use with a wall system.

While the disclosure is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the disclosure.

DETAILED DESCRIPTION

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (e.g., having the same function or result). In many instances, the term "about" may include numbers that are rounded to the nearest significant figure.

The recitation of numerical ranges by endpoints includes all numbers within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise. It is noted that references in the specification to "an embodiment", "some embodiments", "other embodiments", etc., indicate that the embodiment described may include one or more particular features, structures, and/or characteristics. However, such recitations do not necessarily mean that all embodiments include the particular features, structures, and/or characteristics. Additionally, when particular features, structures, and/or characteristics are described in connection with one embodiment, it should be understood that such features, structures, and/or characteristics may also be used in connection with other embodiments whether or not explicitly described unless clearly stated to the contrary.

The following detailed description should be read with reference to the drawings in which similar elements in different drawings are numbered the same. The drawings, which are not necessarily to scale, depict illustrative embodiments and are not intended to limit the scope of the invention.

Walls and wall structures may have various designs, may have various dimensions, and may be made from various materials. In some cases, the designs, dimensions, and materials of a wall or wall structure may depend, at least in part, on the purpose of the wall.

Typical walls and wall structures may be provided for various decorative and/or functional purposes. For example, walls and wall structures may be provided for decorative purposes and may include painted artwork, sculpted artwork, wood designs, and/or other decorative features. Further, walls and wall structures may be provided to allow people to see through (e.g., a wall or wall structure including one or more windows), to keep people, animals, weather, and/or objects in or out of a building, to protect occupants of a building, and/or to provide one or more other functional and/or decorative purposes In some cases, walls or wall structures may be configured to be ballistic resistant. In one example, a wall or wall structure may be provided with a decorative or functional purpose to protect people and things on one side of the wall or wall structure from people, animals, bullets, ballistic material, and/or other uninvited things on another side of the wall or wall structure.

Further, walls or wall structures may be generally configured in a grid-like pattern or other pattern, where a wall panel may be supported by panel supports. Examples of such walls or wall structures may be storefront wall systems, curtainwall wall systems, and/or other wall systems. Curtainwall wall systems and/or other wall systems may typically comprise a grid-like framework usually made of aluminum or steel transoms (e.g., structures that typically run horizontally) and mullions (e.g., structures that typically run vertically), where the framework typically may be attached to a building structure and may typically receive glazing or window panels and/or non-transparent panels.

In some cases, walls or wall structures may be movable to cover and/or provide access to other walls or wall structures, windows, doors, doorways, etc. An example of such a wall structure may be and/or may include a shutter panel, a slider panel, and/or other suitable panels that may be movable to cover and/or protect a window.

Ballistic resistant walls or wall structures may typically include a ballistic resistant wall panel (e.g., a panel of ballistic resistant glass or other panel including ballistic resistant material) surrounded by wall supports or brackets to join adjacent ballistic resistant wall panels. A "ballistic resistant" thing or material may be defined as a thing or material that provides protection to a person or object positioned behind the thing or material against complete penetration of a projectile (e.g., a bullet or other projectile), passage of fragments or projectiles therethrough, or fragmentation of the thing or material in response to a projectile engaging the thing or material. Example ballistic resistant materials, walls, and wall structures are discussed in U.S. Pat. No. 9,976,306, filed on Mar. 31, 2017, and titled WALL SUPPORT STRUCTURES AND SYSTEMS, which is hereby incorporated by reference in its entirety for all purposes.

The standards set by the current UL 752 may be utilized to determine a level of ballistic resistance for a thing or material (e.g., wall panel, wall support, material thereof, and/or other thing or material). Under the current UL 752 standard, a ballistic resistant thing or material having a protection level of Level 1 will protect against handguns of medium power (e.g., hand guns firing 9 mm full metal copper jacket with lead core ammunition or handguns having a muzzle energy of 380-460 foot pounds or 515-624 Joules), a ballistic resistant thing or material having a protection level of Level 2 will protect against handguns of higher power (e.g., handguns firing 0.357 magnum jacket lead soft point ammunition or handguns having a muzzle energy of 548-663 foot pounds or 743-899 Joules) Joules, a ballistic resistant thing or material having a protection level of level 3 will protect against handguns of super power (e.g., handguns firing 0.4 magnum lead semi-wadcutter gas checked ammunition or having a muzzle energy of 971-1,175 foot pounds or 1,317-1,593 Joules), a ballistic resistant thing or material having a ballistic resistance level of Level 4 will protect against low caliber rifles (e.g., .30 caliber rifle lead core soft point (.30-06 caliber), a ballistic resistant thing or material having a ballistic resistance level of Level 5 will protect against one shot of rifle ammunition (e.g., 7.62 mm rifle lead core full metal copper jacket, military ball (.308 caliber)—1 shot), and a ballistic resistant thing or material having a ballistic resistance level of Level 8 will protect against five shots of rifle ammunition (e.g., 7.62 mm rifle lead core full metal copper jacket, military ball (.308 caliber)—5 shots). These are just some example levels of ballistic resistance as set by the current UL 752 standard, but the current UL 752 standard has additional levels. Additionally, other standards (e.g., National Institute of Justice Body Armor Classification standards and/or other standards) may be utilized for determining a level of ballistic resistance for a thing or material.

Turning to the Figures, FIG. 1 depicts a schematic plan view of an illustrative panel system 2 including a panel 10. In the configuration of FIG. 1, the panel 10 may be a movable ballistic resistant shutter panel configured to provide movable ballistic resistant protection along a window 12 in a wall system 14. The panel 10 may be mounted (e.g., secured) to and/or with respect to the wall system 14 and/or an adjacent ceiling or flooring such that the panel 10 may be moved behind the window 12 (e.g., on a safe side of the window 12) to secure the window 12 from an outside attacker. Although the panel 10 is depicted in FIG. 1 as being movable to secure the window 12 from an outside attacker, the panel 10 may be mounted adjacent a door/doorway 13 of the wall system 14 to secure the door/doorway 13 from an outside attacker.

The panel 10 may be mounted so as to be movable in any suitable manner. For example, the panel 10 may be mounted with one or more mounts that facilitate the panel(s) 10 being slidably movable, pivotally movable, rotatably movable, linearly movable, and/or movable in any other suitable manner.

As shown in FIG. 1, the panel 10 is pivotally mounted via a hinge mount, such that the movable panel 10 may be rotated about a pivot axis of the hinge. Although the panel 10 is shown as being pivotable about ninety degrees in FIG. 1, the panel 10 may be configured to pivot less than ninety degrees or more than ninety degrees. Further, the panel 10 may be mounted such that the panel 10 may be stored against a wall of the wall system 14 when not in use securing a window or door/doorway from an outside attacker and moved (e.g., swung) to a desired position to secure the window or door/doorway from the outside attacker when the attacker is or is anticipated to be present.

In some cases, the panel(s) 10 may be configured, as discussed herein, so as to be quickly and/or easily movable from a closed or non-securing position to an opened or securing position. Further, the panel system 2 and the panel(s) 10 thereof may be concealed or designed to fit in with a space, such that an attacker that may be unfamiliar with the space may believe the panel system 2 and/or the panel(s) 10 may be regular wall structures and/or functional/decoration features within a space.

The movable panel 10 may be mounted with any suitable mount 15 to meet a weight load and/or movement range of the specified panel 10. Example mount types include, but are not limited to a hinge, a continuous geared hinge, load bearing ball bearing hinges, slide systems, drawer slide systems, and/or other suitable mount types. In some cases, the panel 10 may be mounted to the wall via a header type panel that may be attached to the wall before and/or after finishes, such that the header type panel may become the pivot point for the panel 10.

The panel 10 may include a lock, such as a floor bolt 16 and/or a ceiling bolt configured to engage the floor and/or the ceiling, respectively, adjacent the wall system 14. The floor bolt 16 and/or the ceiling bolt may be configured to facilitate the panel 10 maintaining a set or desired position. In some cases, the floor bolt 16, the ceiling bolt, and/or other locking mechanisms may be reinforced and configured to withstand an attack on the panel 10. In addition to or as an alternative to the floor bolt 16 and/or the ceiling bolt, a wall catch or other retention device may be utilized to limit undesired movement of the panel 10 (e.g., by an attacker). Alternatively or additionally, the panel 10 may include one or more other suitable locking mechanisms configured to secure panel(s) 10 at a fully closed position, at a fully opened position, and/or at a position between the fully closed position and the fully opened position.

The foot or base of the panel 10 may be configured to remain as close to the floor as possible. To facilitate such a configuration and/or for other purposes, the panel 10 may include a wheel 18 (e.g., on a safe side of, attacker side of, and/or in the panel 10) to allow for easier movement when moving (e.g., swinging, sliding, rotating, etc.) the panel 10.

Further, in some cases, a wall stiffener 20 (e.g., a vertical wall stiffener) may be applied to and/or adhered to (e.g., via an adhesive and/or other connector) a wall of the wall system 14 and the panel 10 may be secured to the wall system 14 through the vertical wall stiffener 20. In some cases, the wall stiffener 20 may include a decorative finish and decorative screws and/or other suitable fasteners may be utilized to attach the wall stiffener 20 to the wall system 14.

Figure 2:
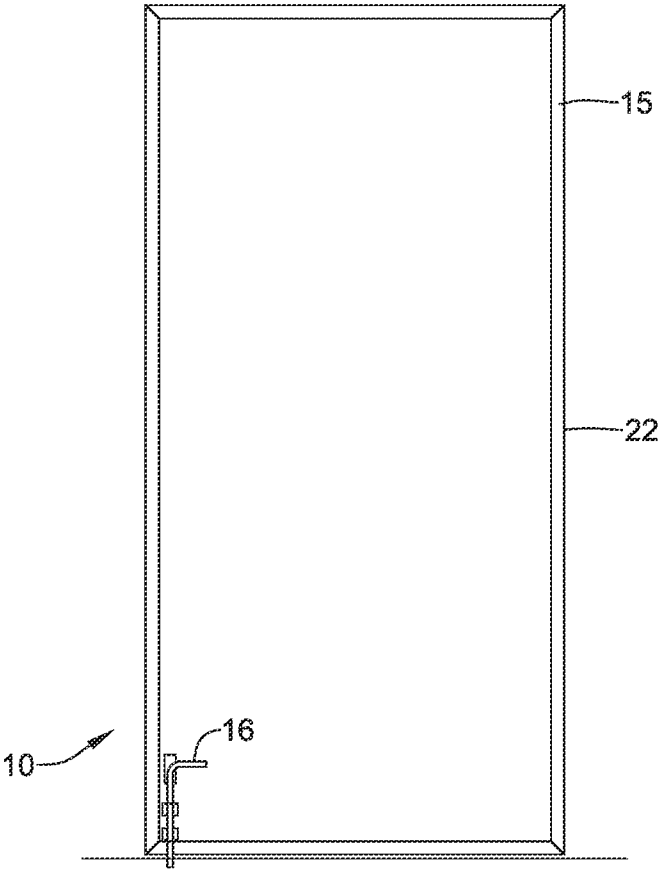
FIG. 2 is a schematic elevation view of an illustrative ballistic resistant panel system.
Figure 3:
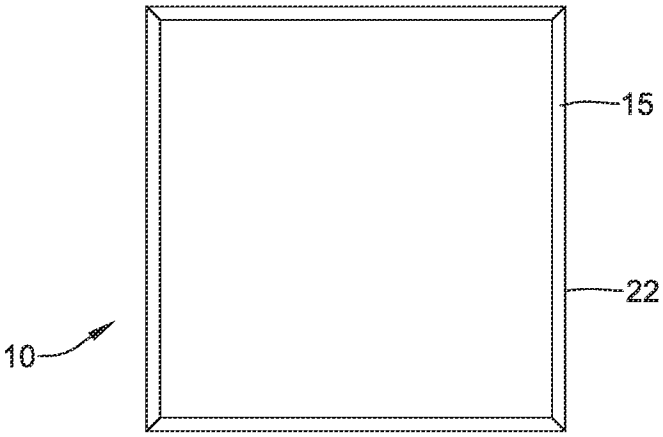
FIG. 3 is a schematic elevation view of an illustrative ballistic resistant panel system.

FIGS. 2 and 3 depict schematic elevation views of illustrative configurations of the panel 10. FIG. 2 depicts an illustrative wall or door-height configuration of the panel 10. FIG. 3 depicts an illustrative partial wall or door-height configuration of the panel 10.

Figure 4:
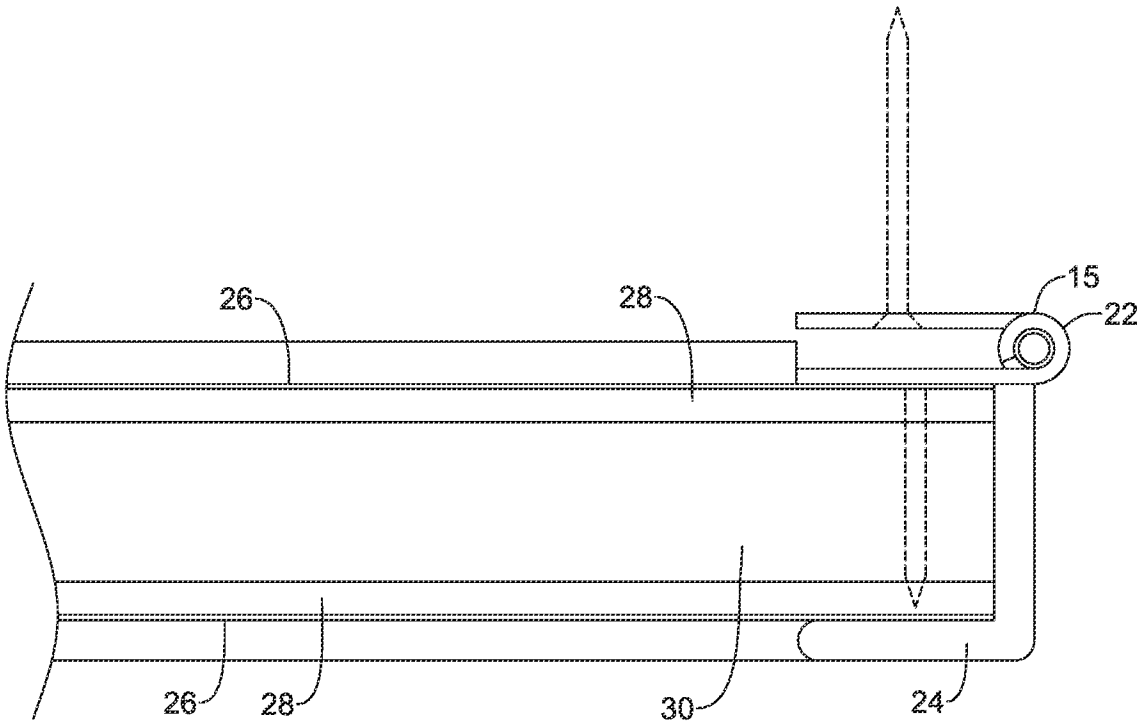
FIG. 4 is sectional view of a portion of a ballistic resistant panel system.

As shown in FIG. 2, the wall or door-height 10 is depicted as having a mount 15 that is a hinge (e.g., a hinge 22, as depicted in FIG. 4, which may be a continuous hinge, and/or other suitable hinge or mount structure) that runs along a height of the wall or door-height panel 10. The continuous hinge may facilitate rotation of the wall or door-height panel 10 about the hinge 22 as needed to secure a space behind a window and/or door/doorway.

The movable wall or door-height panel 10 may have any suitable dimensions. In some cases, the wall or door-height panel 10 may be configured to extend entirely or approximately entirely between a ceiling and a floor adjacent a wall of a wall system. In one example, as depicted in FIG. 2, the wall or door-height panel 10 may have a height of ninety-six (96) inches and a width of forty eight (48) inches. In some cases, about 0.5 inches may be left between the panel 10 and the floor and/or the ceiling, but this is not required. Other suitable dimensions are contemplated.

As shown in FIG. 3, the partial wall or door-height configuration of the panel 10 is depicted as having mount 15 (e.g., a continuous hinge and/or other suitable mount) that runs along a height of the partial wall or door-height panel 10. Although the mount 15 runs along the height of the partial wall or door-height panel 10, the mount 15 may include one or more mounts and may extend less than the full height of the panel 10. The mount 15 may facilitate rotation of the partial wall or door-height panel 10 about an axis thereof as needed to secure a space behind a window and/or door/doorway.

The partial wall or door-height panel 10 may have any suitable dimensions. In some cases, the partial wall or door-height panel 10 may be configured to extend partially between a ceiling and a floor adjacent a wall of a wall system (e.g., to cover an opening in a wall systems, such as a window and/or other suitable opening). In one example, as depicted in FIG. 3, the wall or door-length panel 10 may have a height of forty-eight (48) inches and a width of forty-eight (48) inches. In some cases, about 0.5 inches may be left between the panel 10 and the floor and/or the ceiling, but this is not required. Other suitable dimensions are contemplated.

FIG. 4 is a schematic cross-sectional view of a portion of the panel 10 secured to the wall system 14 using the hinge 22. The panel 10 may be formed from any suitable material configured to facilitate stopping and/or slowing down an attacker. In some cases, the panel 10 may be multi-layered. As shown in FIG. 4, the panel 10 may be configured with an exterior finished surface layer 26 on both sides of the panel 10, interior of the exterior finished surface 26 on both sides of the panel 10 there may be a core backer layer 28 (e.g., any suitable construction backer material), and interior of the core backer layer 28 there may be one or more layers of ballistic resistant material 30.

In some cases, an edge wrap 24 may be utilized for decorative and/or functional purposes and may wrap around an end of the panel 10 to cover one or more layers forming the panel 10. In addition to or as an alternative to utilizing the edge wrap 24, the layers of the panel 10 may be secured to one another in any suitable manner including, but not limited to, laminating the layers, using adhesive, using one or more fasteners, etc.

The finished surface layer 26 may utilize one or more decorative or functional materials. For example, the finished surface layer 26 may be configured from one or more of plastic laminate, wood, metal, polymer, white board material, pin board materials, cork boards, glass, fabric, veneer, fabric, wall paper, paint, magnetic materials, chalkboard, material, and/or other suitable materials. The finished surface layer 26 may have a functional configuration with which a user may be able to interact including, for example, a white board surface, a chalkboard surface, a magnetic surface, a cork board surface, a glass surface, etc.

The layer(s) of ballistic resistant material 30 (e.g., a ballistic resistant core and/o rother suitable layer) may be formed from any suitable type of material configured to stop the penetration of bullets. In some cases, the ballistic resistant material 30 may be configured to UL1-8 standards using one or more sub-layers of suitable types of material. Example bullet and/or ballistic resistant materials are discussed in U.S. Pat. No. 9,976,306, which is incorporated by reference herein.

The edge wrap 24 may be any suitable material configured to form a moulding to make the corners of the panel 10 safe to the touch. Example materials for the edge wrap 24 may include, but are not limited to, metals, polymers, fiberglass pultrusion, aluminum, stainless steel, wood, and/or other suitable materials.

Figure 5:
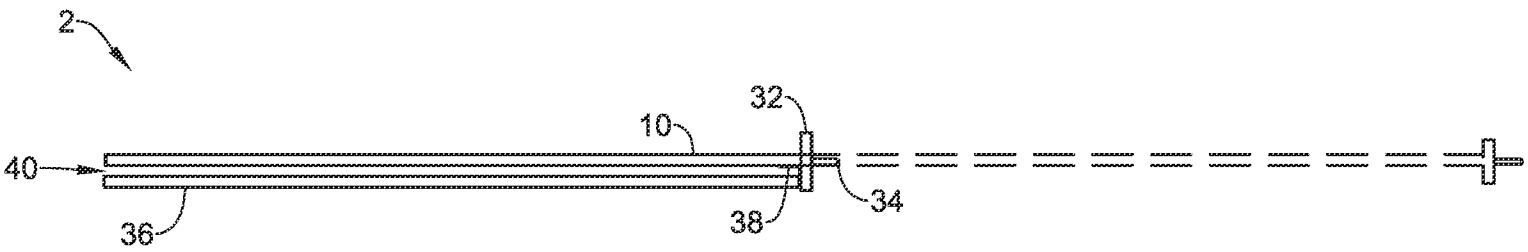
FIG. 5 is a schematic plan view of an illustrative ballistic resistant panel system.

FIGS. 5-11 depict the panel system 2 with the panel 10 in a pocket door configuration. As depicted in FIGS. 5-11, the panel 10 may be configured as a movable ballistic resistant slider panel. Further, although the panel system 2 is depicted in FIG. 5 as having a single panel 10, the panel system 2 may include two or more panels 10, as desired.

FIG. 5 depicts the panel 10 in a closed position. The broken lines in FIG. 5 are phantom lines that indicate a position of the panel 10 when the panel 10 is in an opened and/or protection position. Although the opened position is described as being the protecting position of the panel 10, it is contemplated that the closed position of the panel 10 may also or alternatively be a protecting position.

The panel 10 may have any suitable dimensions. For example, the panel 10 may be configured to at least partially block an opening in a wall structure when in the opened position and fit at least partially within or along a wall system when in the closed position.

As depicted in FIG. 5, the panel 10 may be connected to an end panel 32. The end panel 32 may be formed from any suitable type of material. Example materials for the end panel 32 may include, but are not limited, polymers, metals, ballistic resistant materials, wood, and/or other suitable material. The material of end panel 32 may include a decorative and/or functional outer layer, as discussed herein, so as to have one or more decorative and/or functional surface portions. The end panel 32 may be configured to at least partially house the panels 10, but this is not required.

A handle 34 may be connected to one or both of the end panel 32 and the panel 10. The handle 34 may be utilized to facilitate moving the panel 10 between the closed position and the opened position. In one example, a force may be applied to the handle 34 in a direction that is at least partially in a desired direction of movement of the panel(s) 10 to cause movement of the panel(s) 10 in the desired direction.

The handle 34 may take on any suitable handle configuration. Example handle configurations include, but are not limited to, knobs, pulls, bars, u-shaped handles, and/or other suitable handle confirmations.

The handle 34 and/or the end panel 32 may be connected to the panel 10 using a connector 38. The connector 38 may be and/or may include any suitable connector component(s). Example components of the connector 38 may include, but not are limited to, screws, bolts, nuts, adhesives, brackets, etc.

The panel system 2 depicted in FIG. 5 may include one or more supports 36 configured to facilitate securing the panel system 2 to a wall system. The support 36 may take on any suitable configuration for securing the panel system 2 to a wall system. In some cases, the particular configuration of the support 36 may be dictated by a structure of the wall system to which the panel system 2 will be attached, but this is not required.

The support 36 may be formed from one or more suitable materials for connecting to the panel 10 and/or to the wall system 14. Example suitable materials include, but are not limited to, metal, polymer, wood, plywood, natural fibers, ballistic resistant materials, decorative materials, functional materials, etc. In one example, the support 36 may be at least partially or entirely formed from plywood.

Although FIG. 5 depicts a space 40 between the panel 10 and the support 36 one or more features may be located therebetween. In some cases, a connection feature connecting the panel 10 to the support 36 may be in the space 40, but this is not required. In one example, one or more slider systems may be at least partially located in the space 40 and configured to connect the panel 10 to the support 36 and/or facilitate movement of the panel 10 relative to the support 36.

Figure 6:
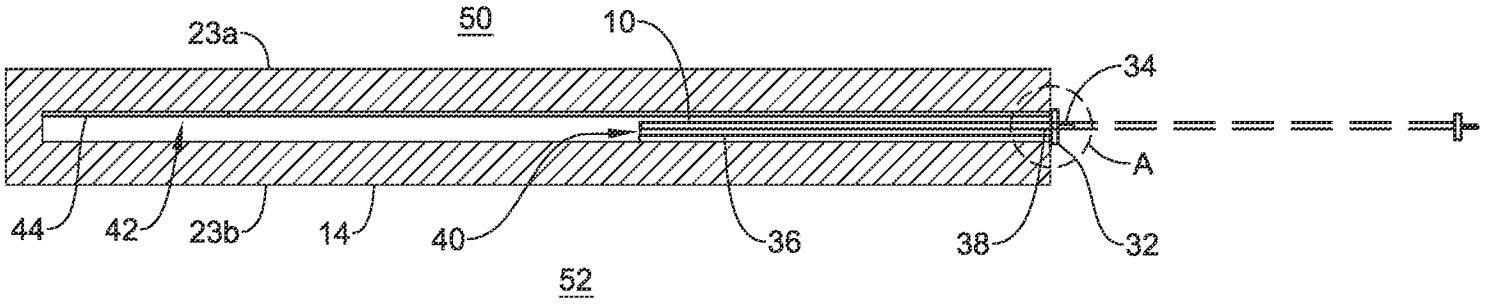
FIG. 6 is a schematic plan view of the illustrative ballistic resistant panel system depicted in FIG. 5 in a wall system.

FIG. 6 depicts the panel system 2 depicted in FIG. 5 within a wall system, such as the wall system 14. In the example depicted in FIG. 6, the panel system 2 has been inserted within a gap 42 between a first wall panel 23*a* and a second wall panel 23*b* similar to how a pocket door may be positioned between wall panels of a wall system. In such a configuration, the support 36 may be secured to a wall panel of the wall system 14 in any suitable manner including, but not limited to, by using one or more of adhesives, fasteners, connectors, etc.

Although not required, when installing the panel system 2 along or within a wall system, one or more ballistic resistant wall panels 44 may be secured to a wall panel of the wall system 14. In one example, the ballistic resistant wall panel 44 may be secured to the first wall panel 23*a* and the support 36 may be secured to second wall panel 23*b*. In such an instance, the first wall panel 23*a* may be a wall panel facing a space 50 exterior to a space 52 intended to be protected by the panel system 2 and the second wall panel 23*b* may be a wall panel facing the space 52 intended to be protected by the panel system 2, but this is not required.

Figure 7:
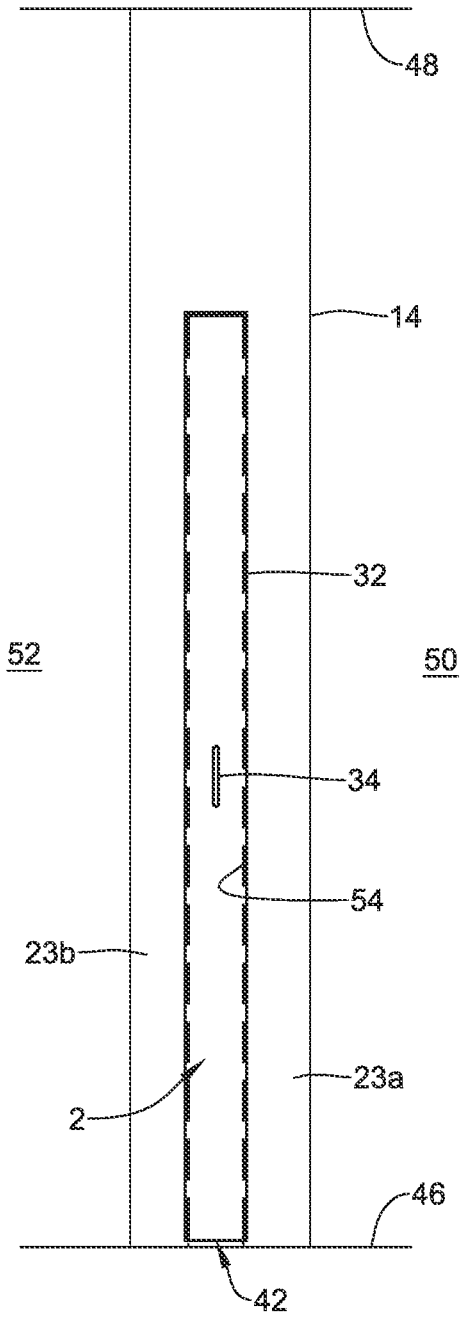
FIG. 7 is a schematic front elevation view of the illustrative ballistic resistant panel system depicted in FIG. 6.

FIG. 7 depicts an illustrative end view of the panel system 2 within the wall system 14 extending between a floor 46 and a ceiling 48. As depicted in FIG. 7, the end panel 32 of the panel system 2 may extend beyond a profile 54 (e.g., as represented by broken lines in FIG. 7) of an opening in the wall system 14 that receives at least portion of the panel system 2. Alternatively or additionally, at least a portion of the end panel 32 may be configured to fit within the profile 54 so as to have a surface flush with an outer surface of the wall system 14 when the panel system 2 is in the closed position.

Figure 8:
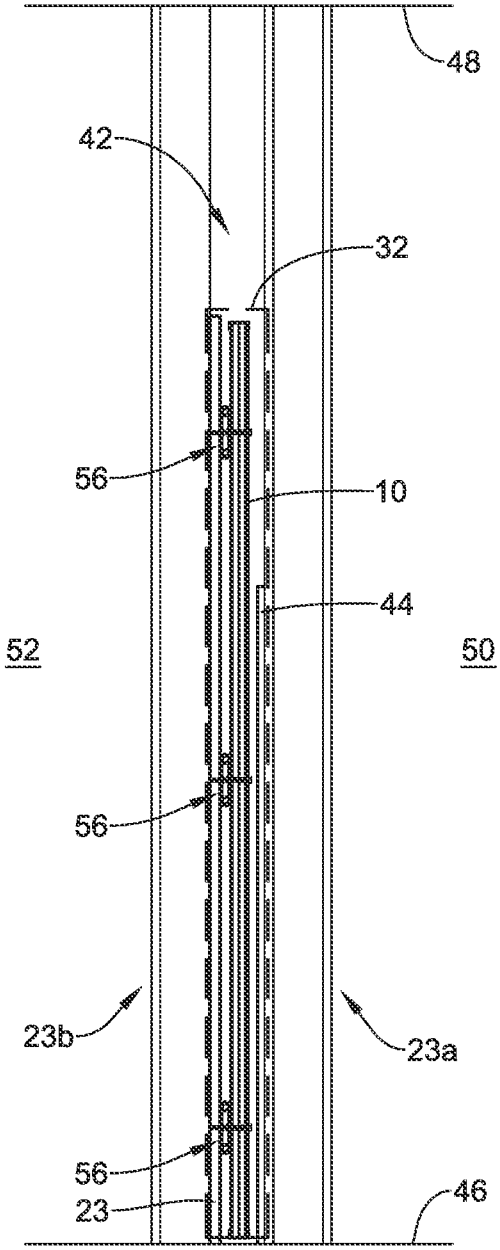
FIG. 8 is a schematic front elevation view of the illustrative ballistic resistant panel system depicted in FIG. 6, with an end panel removed.

FIG. 8 depicts an illustrative end view of the panel system 2 within the wall system 14 extending between the floor 46 and the ceiling 48, where the end panel 32 (shown in broken lines) of the panel system 2 and an end surface of the wall structure are removed to depict the gap 42 between wall panels 23*a* and 23*b*. As depicted in FIG. 8, the panel 10 may be connected to or mounted to the support 36 with one or more mounts (e.g., mounts 15, such as connector systems 56, and/or other suitable mounts).

The connector systems 56 may be any suitable mounting connector systems and may be configured to facilitate movement of the panel 10 relative to the wall system 14 and/or the support 36. In one example, the connector systems 56 may be or may include slide systems (e.g., a drawer slider system using bearings and/or other suitable slider systems) configured to facilitate sliding movement of the panel relative to the support 36 and the wall system 14, but this is not required. As depicted in FIG. 8, the panel system 2 may include three (3) connector systems 56, but other suitable numbers of connector systems 56 may be utilized as needed to support the panel 10 in the closed position, the opened position, and during movement therebetween.

Although the connector system 56 is depicted as being secured to the support 36 and the panel 10 using screws, nuts, and bolts, other connector components may be utilized as desired. Further, although the screws, nuts, and bolts are viewable in FIG. 8 for descriptive purposes, these components may not be viewable from the view depicted in FIG. 8.

Figure 9:
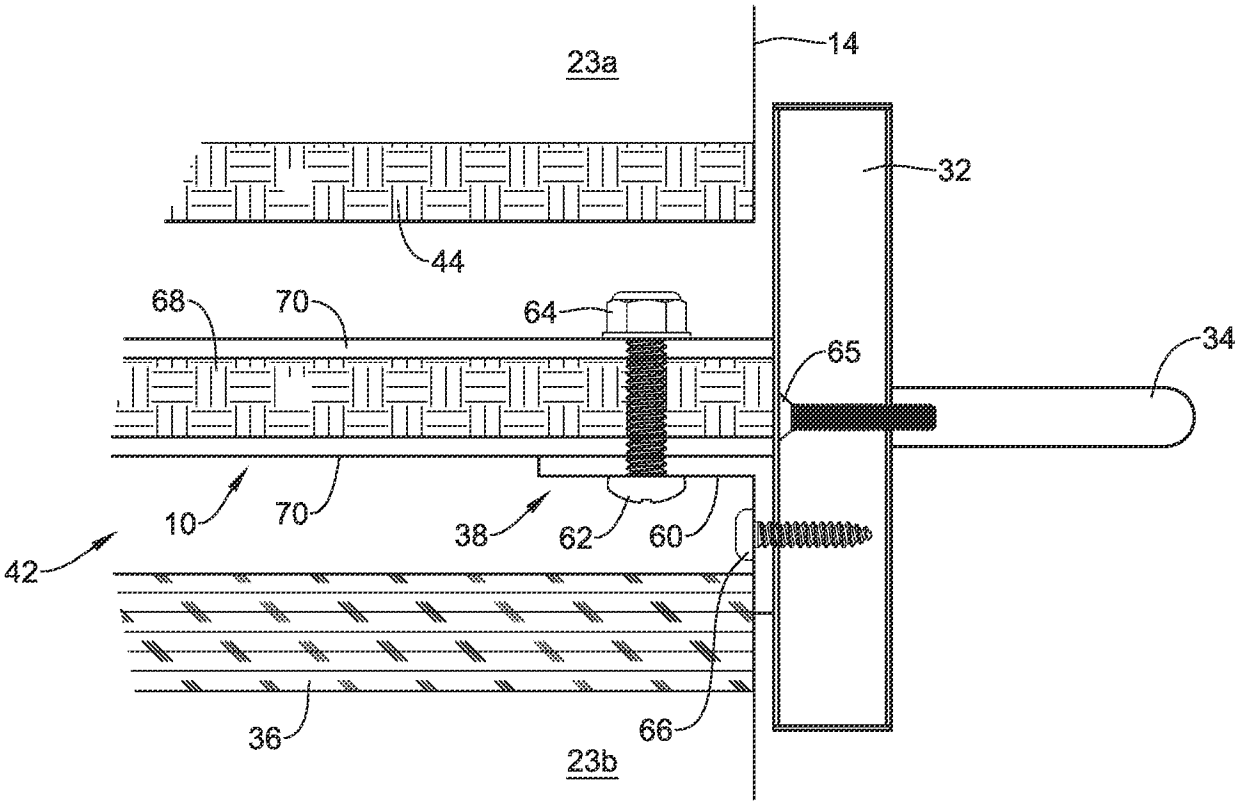
FIG. 9 is a schematic detail sectional view of the illustrative ballistic resistant panel system depicted in FIG. 6, taken from circle A in FIG. 6.
Figure 10:
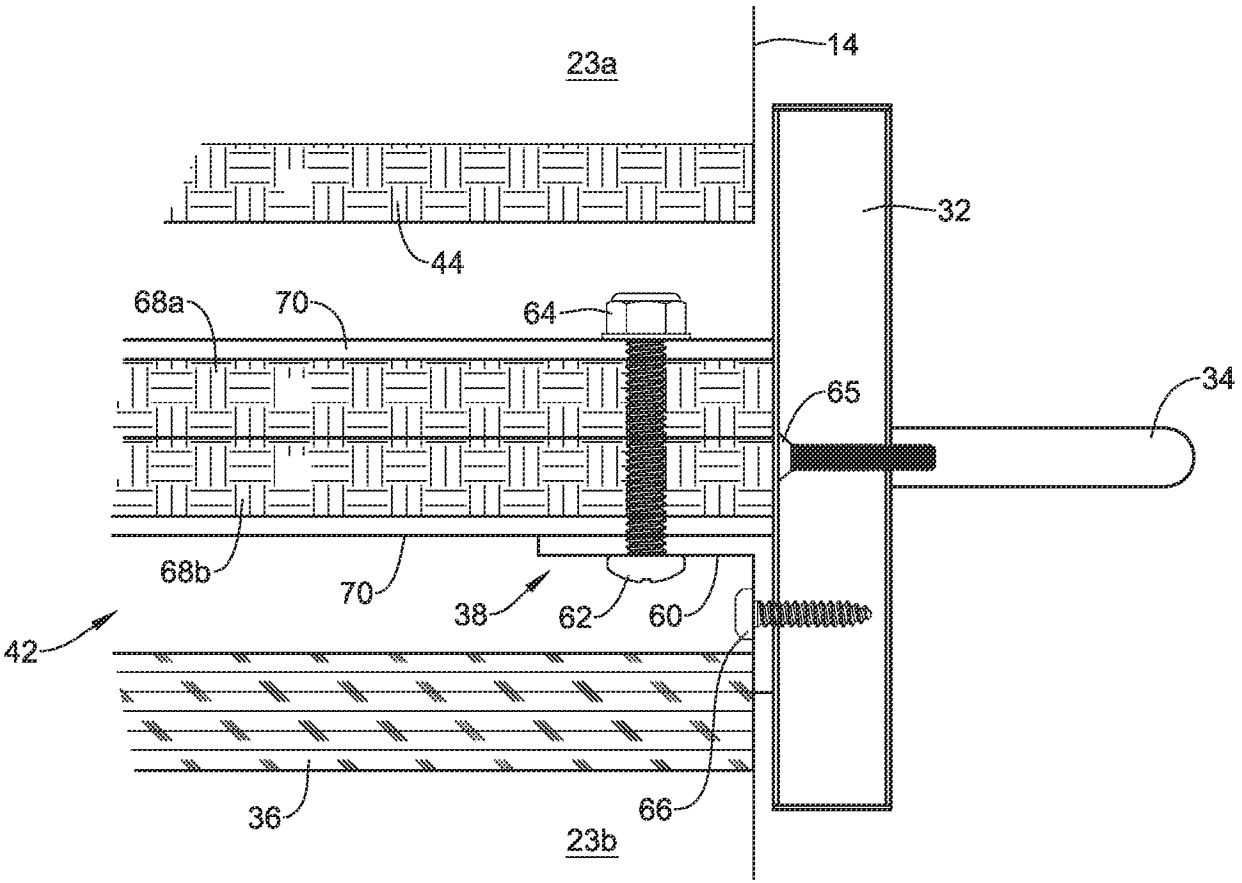
FIG. 10 is a schematic detail sectional view of the illustrative ballistic resistant panel system depicted in FIG. 6, depicting an alternative panel configuration.
Figure 11:
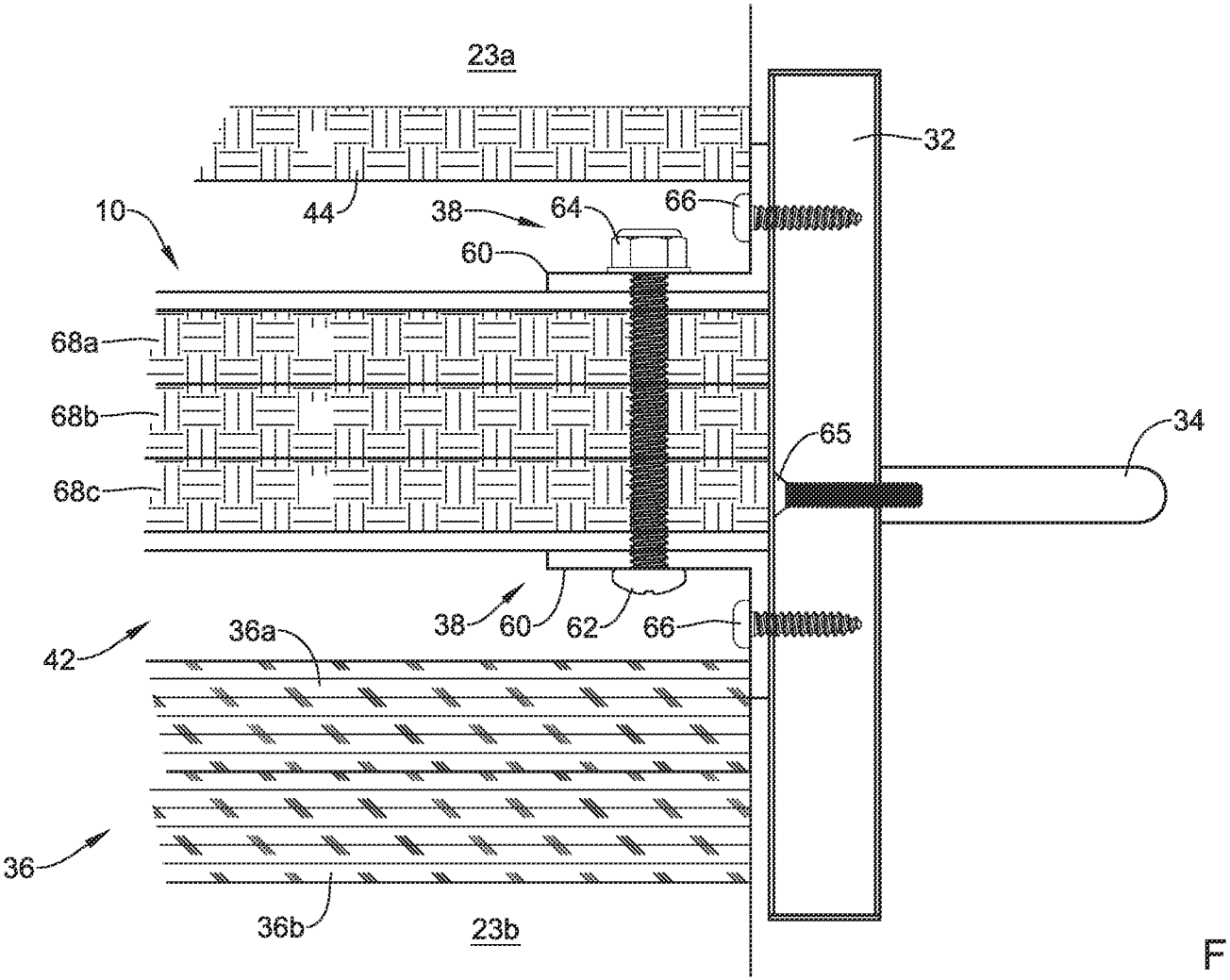
FIG. 11 is a schematic detail sectional view of the illustrative ballistic panel system depicted in FIG. 6, depicting an alternative panel configuration.

FIGS. 9-11 depict details of the illustrative connections between the panel 10, the end panel 32, and the handle 34, along with an illustrative configuration of the panel 10, taken from circle-A in FIG. 5. Although portions of screws and/or bolts are depicted in FIGS. 9-11, certain portions of the depicted screws and/or bolts may not be viewable from the views depicted in FIGS. 9-11.

As depicted in FIGS. 9-11, the connector 38 may include a bracket 60, a bolt 62, and a nut 64 connecting the bracket 60 to the panel 10, and a screw 66 connecting the bracket 60 to the end panel 32. The bracket 60 may be an L-shaped bracket and may extend along a surface of the panel 10 and the end panel 32 to create a tight connector therebetween.

Further, although the bracket 60 is depicted in FIGS. 9-11 as a spacer between the end panel 32 and the support 36 or the wall system 14, this is not required, and the bracket 60 may be configured such that the end panel 32 contacts the wall system 14. Other suitable configurations for the connector 38 and the components thereof are contemplated.

Further, a screw 65 may be utilized to connect the handle 34 to the end panel 32, but other connector configurations and/or components are contemplated. In some cases, the screw 65 may be configured to have a head portion that is flush with an exterior surface of the end panel 32 when the screw 65 is connecting the handle 34 to the end panel 32, as depicted in FIG. 9, which may facilitate creating a tight connection between the panel 10 and the end panel 32 using the connector 38.

As depicted FIG. 9, the panel 10 may be configured from a ballistic resistant layer 68 (e.g., formed from the ballistic resistant material 30 and/or other suitable ballistic resistant core material), an outer layer 70 (e.g., similar to or different than the finished exterior surface layer 26) along one surface of the ballistic resistant layer 68, and another outer layer 70 along another surface of the ballistic resistant layer 68. When connected to the bracket 60, the bolt 62 may extend through one or more of the outer layer(s) 70 and the ballistic resistant layer 68 and connected to the nut 64 to create a tight connection between the panel 10 and the bracket 60.

FIG. 10 depicts similar features to those depicted in FIG. 9, but with a configuration of the panel 10 that differs from the configuration of the panel 10 depicted in FIG. 9. The panel 10 depicted in FIG. 10 may be configured from a first ballistic resistant layer 68*a* and a second ballistic resistant layer 68*b* (e.g., where the first and/or second ballistic resistant layers 68*a*, 68*b* may be formed from the ballistic resistant material 30 and/or other suitable ballistic resistant core material), an outer layer 70 along one surface of the first ballistic resistant layer 68*a*, and another outer layer 70 along a surface of the second ballistic resistant layer 68*b*. When the panel 10 is connected to the bracket 60, the bolt 62 may extend through one or more of the outer layer(s) 70, the first ballistic resistant layer 68*a*, and the second ballistic resistant layer 68*b*, and connected to the nut 64 to create a tight connection between the panel 10 and the bracket 60.

FIG. 11 depicts similar features to those depicted in FIG. 9, but with a configuration of the panel 10 that differs from the configuration of the panel 10 depicted in FIG. 9 and a second connector 38. The panel 10 depicted in FIG. 11 may be configured from the first ballistic resistant layer 68*a*, the second ballistic resistant layer 68*b*, and a third ballistic resistant material 68*c* (e.g., where the first, second, and/or third ballistic resistant layers 68*a*, 68*b* may be formed from the ballistic resistant material 30 and/or other suitable ballistic resistant core material), an outer layer 70 along one surface of the first ballistic resistant layer 68*a*, and another outer layer 70 along a surface of the third ballistic resistant layer 68*c*. When the panel 10 is connected to the bracket 60, the bolt 62 may extend through one or more of the outer layer(s) 70, the first ballistic resistant layer 68*a*, the second ballistic resistant layer 68*b*, and the third ballistic resistant layer 68*c*, and connect to the nut 64 to create a tight connection between the panel 10 and the brackets 60.

As depicted in FIG. 11, two or more connectors 38 may be utilized to facilitate connecting the end panel 32 (e.g., which may be elongated relative to other configurations so as to cover the gap 42 when) to the panel 10. In such instances, the bolt 62 may extend through both of a first bracket 60 and a second bracket 60 to secure the brackets to the panel 10. However, other configurations are contemplated including the use of lag bolts and/or other connectors.

When the panel(s) 10 include two or more layers (e.g., ballistic resistant layers 68 outer layers 70, etc.), the layers may be connected in any suitable manner. In one example, the layers of the panel(s) 10 may be laminated together, connected via an adhesive, connected via one or more connectors, and/or otherwise secured with respect to one another in one or more other suitable manners.

FIGS. 12-16 depict the panel system 2 with the panel 10 similar to that depicted in FIG. 9-11, where the panel system 2 is secured relative to a surface of a wall panel 23 of the wall system 14 in the interior space 52 defined by the wall system 14. Although the panel system 2 is depicted as being located in a corner of the wall system 14, this is not required and the panel system 2 may be located along additional and/or alternative portions of the wall system 14. As depicted in FIGS. 12-16, the panel 10 may be configured as a movable ballistic resistant slider panel.

Figure 12:
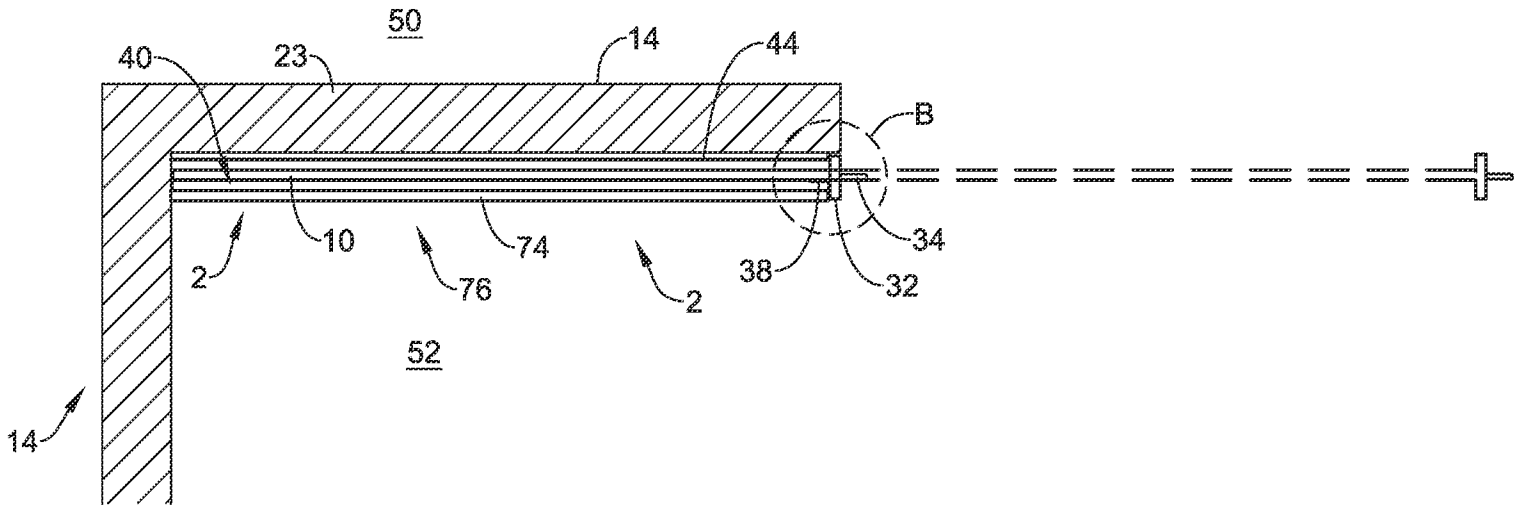
FIG. 12 is a schematic plan view of an illustrative ballistic resistant panel system with a wall system.

FIG. 12 depicts the panel 10 in a closed position. The broken lines in FIG. 12 are phantom lines that indicate a position of the panel 10 when the panel 10 is in an opened and/or protection position. Although the opened position is described as being the protecting position of the panel 10, it is contemplated that the closed position of the panel 10 may also or alternatively be a protecting position.

The panel 10 may have any suitable dimensions. For example, the panel 10 may be configured to at least partially block an opening in a wall structure when in the opened position and fit at least partially within or along a wall system when in the closed position.

As depicted in FIG. 12, the panel 10 may be connected to the end panel 32 and the handle 34 may be connected to one or both of the end panel 32 and the panel 10. The handle 34 may be utilized to facilitate moving the panel 10 between the closed position and the opened position. The handle 34 and/or the end panel 32 may be connected to the panel 10 using a connector 38. The connector 38 may be and/or may include any suitable connector component(s), as discussed herein.

The panel system 2 depicted in FIG. 12 may include one or more housing panels 74 forming a housing 76, where the housing 76 may house the panel 10 when the panel 10 is in a closed position, may connect to the panel 10, and/or have an exterior surface facing a space to be the interior space 52. The housing panels 74 may take on any suitable configuration for covering the panel 10 (e.g., covering the panel(s) 10 entirely or at least partially), for facilitating a connection between the wall system 14 and the panel system 2, and/or for providing decorative and/or functions features to the interior space 52. In some cases, the particular configuration of the housing panels 74 may be at least partially dictated by decorative and/or functional requirements for the interior space 52, but this is not required. Alternatively or additionally, the housing panels 74 may be configured to create a ballistic resistant housing 76.

The housing panels 74 may be configured to form a box around the panel(s) 10 to create a housing (e.g., the housing 76 and/or other suitable housing) that surrounds the panel(s) 10 while the panel(s) 10 are in the closed position. In such a configuration, the housing panels 74 may interact with the end panel 32 to fully enclose and/or conceal the panel(s) 10. In some cases, the housing panels 74 may abut or otherwise interact with one or more walls of a wall system (e.g., the wall system 14 and/or other suitable wall system) to form a housing that surrounds the panel(s) 10 while the panel(s) 10 are in the closed position.

In instances when the housing panels 74 form at least part of the housing 76, the housing 76 may be configured to be stationary relative to a wall system. Alternatively or additionally, the housing 76 may be configured to be movable (e.g., on wheels, slides, etc.) relative to a wall system.

The housing panels 74 may be formed from one or more suitable materials for covering the panel 10, for connecting to the panel 10, for connecting to the wall system, and/or for one or more other suitable purposes. Example suitable materials include, but are not limited to, metal, polymer, wood, plywood, natural fibers, ballistic resistant materials, decorative materials, functional materials, etc. In one example, the housing panels 74 may be at least partially or entirely formed from decorative materials (e.g., a finished wood material, etc.) and/or functional features (e.g., a white board material, chalkboard material, pin board material, etc.).

Although FIG. 12 depicts the space 40 between the panel 10 and the housing panel 74, one or more features may be located therebetween. In some cases, a connection feature connecting the panel 10 to the support 36 may be in the space 40, but this is not required.

Although not required, when installing the panel system 2 along the wall system 14, one or more ballistic resistant wall panels 44 may be secured to a wall panel of the wall system 14. In one example, the ballistic resistant wall panel 44 may be secured to a wall panel facing the space 50 exterior to the space 52 intended to be protected by the panel system 2, but this is not required.

Figure 13:
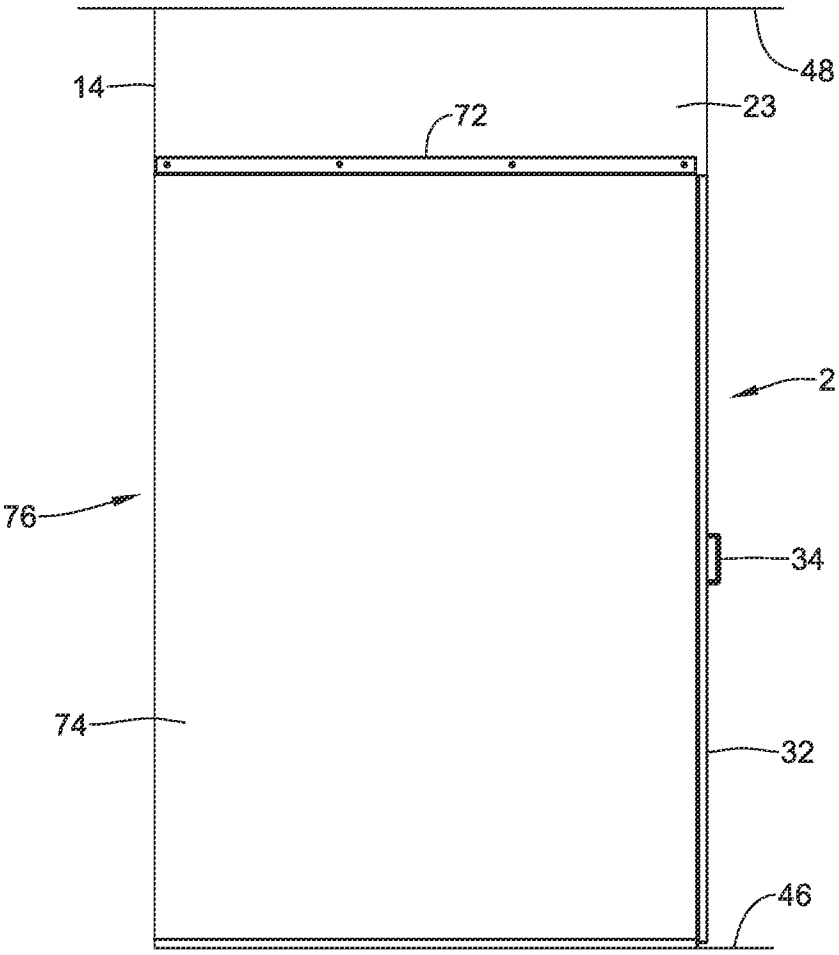
FIG. 13 is a schematic side elevation view of the illustrative ballistic resistant panel system depicted in FIG. 12.

FIG. 13 depicts a side plan view of the illustrative panel system 2 secured with respect to the wall system 14 extending between the floor 46 and the ceiling 48. The panel system 2 may be secured to the wall system 14 in any suitable manner. As depicted in FIG. 13, the panel system 2 may be secured to the wall system 14 using an attachment angle 72 and one or more fasteners and/or connectors configured to secure the attachment angle 72 to the housing panel 74 and/or the wall system 14. Other suitable configurations are contemplated for securing the panel system 2 to the wall system 14.

Figure 14:
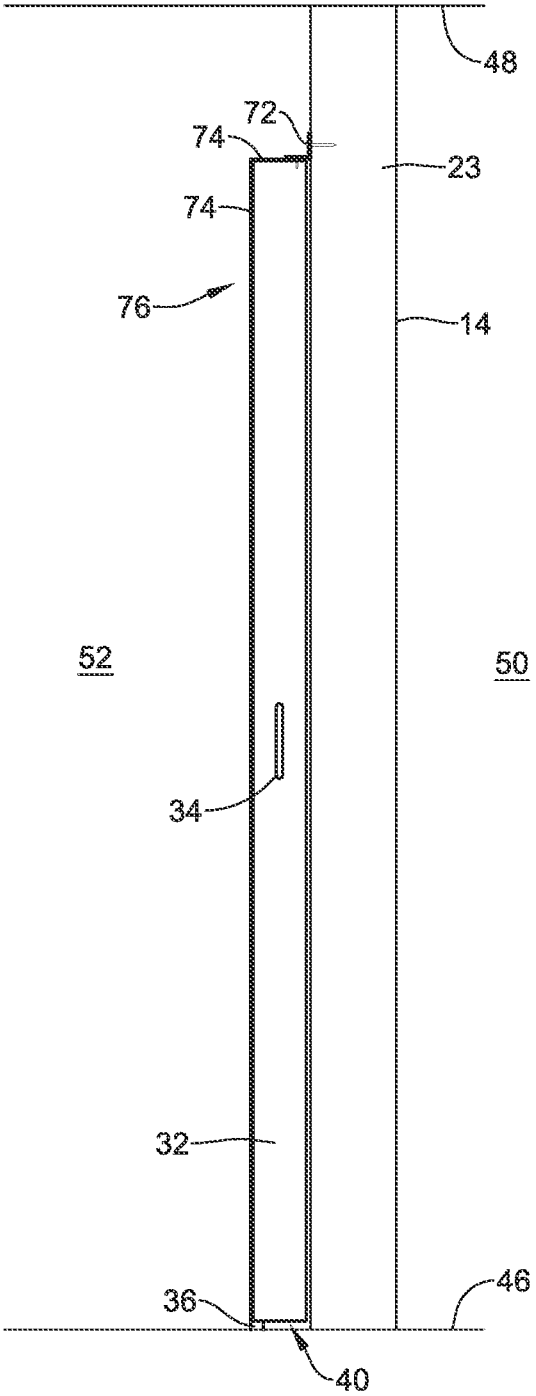
FIG. 14 is a schematic front elevation view of the illustrative ballistic resistant panel system depicted in FIG. 12.

FIG. 14 depicts an illustrative end view of the panel system 2 secured to a surface of the wall system 14 extending between the floor 46 and the ceiling 48. As depicted in FIG. 14, the end panel 32 of the panel system 2 may extend beyond an opening between the support 36 and the wall system 14 that receives at least a portion of the panel system 2 (e.g., a portion of the panel 10). Alternatively or additionally, at least a portion of the end panel 32 may be configured to fit within the opening between the housing panel 74 and the wall system 14 so as to have a surface flush with an outer surface of the wall system 14 and/or the support 36 when the panel system 2 is in the closed position.

Figure 15:
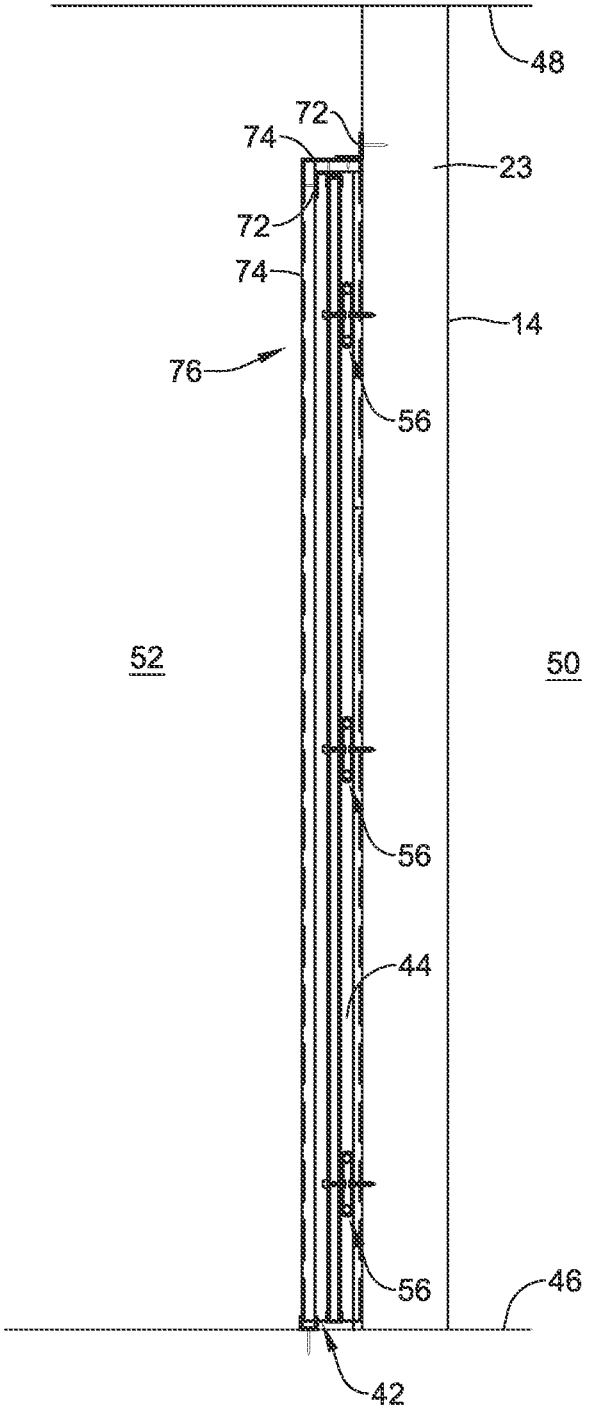
FIG. 15 is a schematic front elevation view of the illustrative ballistic resistant slide panel depicted in FIG. 12, with an end panel removed.

FIG. 15 depicts an illustrative end view of the panel system 2 secured along the wall system 14 extending between the floor 46 and the ceiling 48, where the end panel 32 (shown in broken phantom lines) of the panel system 2 is removed to depict the gap 42 between wall system 14 and the housing panel 74. As depicted in FIG. 15, the panel 10 may be connected to or mounted to the wall system 14 with one or more of the mounts (e.g., mounts 15, such as the connector systems 56, and/or other suitable mounts), as discussed herein. As depicted in FIG. 15, the panel system 2 may include three (3) connector systems 56, but other suitable numbers of connector systems 56 may be utilized as needed to support the panel 10 in the closed position, the opened position, and during movement therebetween.

Although the connector system 56 is depicted as being secured to the wall system 14 and the panel 10 using screws, nuts, and bolts, other connector components may be utilized as desired. Further, although the screws, nuts, and bolts are viewable in FIG. 15 for descriptive purposes, these components may not be viewable from the view depicted in FIG. 15.

FIG. 15 depicts an attachment angle 72 extending between the housing panels 74. In some cases the attachment angle 72 may be secured to adjacent housing panels 74 to support and stabilize the housing 76, but this is not required. The attachment angle 72 may be secured to the housing panels 74 in any suitable manner, including those discussed herein.

Figure 16:
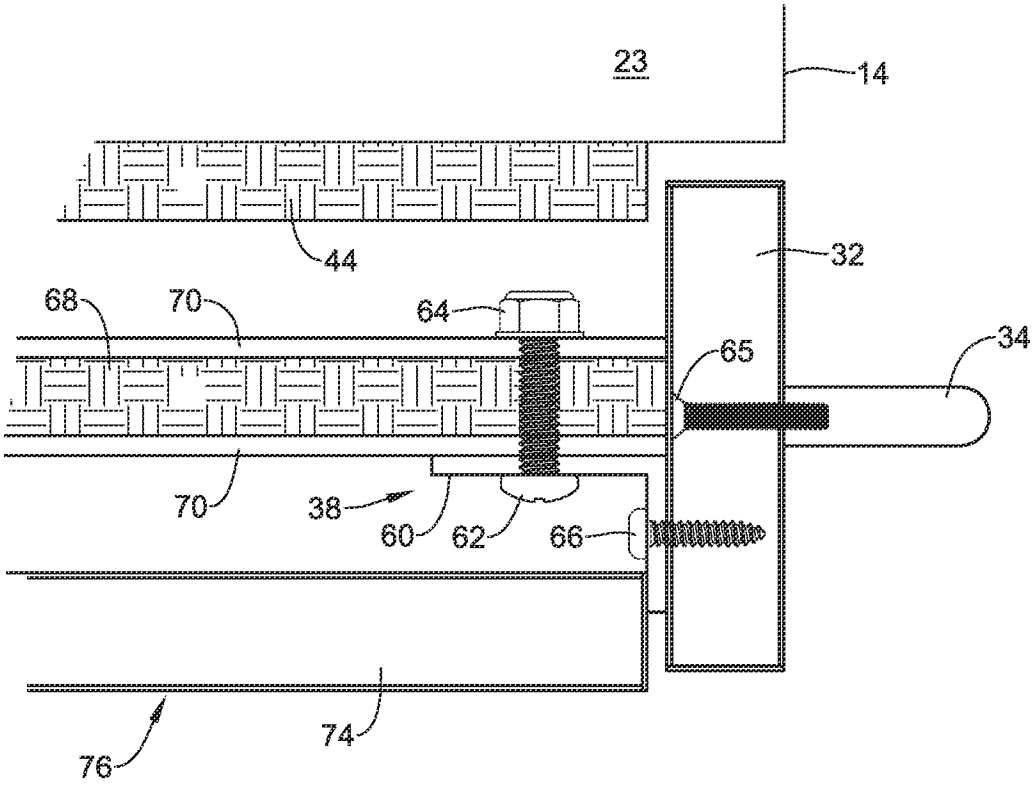
FIG. 16 is a schematic detail sectional view of the illustrative ballistic resistant slide panel depicted in FIG. 12, taken from circle B in FIG. 12.

FIG. 16 depicts details of the illustrative connections between the panel 10, the end panel 32, and the handle 34, along with an illustrative configuration of the panel 10. Although portions of screws, nuts, and/or bolts are depicted in FIG. 16 for descriptive purposes, certain portions of the depicted screws, nuts, and/or bolts depicted may not be viewable from the view of FIG. 16.

As depicted in FIG. 16, the connector 38 may include the bracket 60, the bolt 62, and the nut 64 connecting the bracket 60 to the panel 10, and the screw 66 connecting the bracket 60 to the end panel 32. Further, a screw 65 may be utilized to connect the handle 34 to the end panel 32, but other connector configurations and/or components are contemplated.

Further, although the bracket 60 is depicted in FIG. 16 as a spacer between the end panel 32 and the housing panel 74, this is not required, and the bracket 60 may be configured such that the end panel 32 contacts housing panel 74. Other suitable configurations of the connector 38 and the components thereof are contemplated.

As depicted in FIG. 16, the panel 10 may be configured from the ballistic resistant layer 68 (e.g., formed from the ballistic resistant material 30 and/or other suitable ballistic resistant core material), an outer layer 70 along one surface of the ballistic resistant layer 68, and another outer layer 70 along another surface of the ballistic resistant layer 68. When connected to the bracket 60, the bolt 62 may extend through one or more of the outer layer(s) 70 and the ballistic resistant layer 68 and connected to the nut 64 to create a tight connection between the panel 10 and the bracket 60. Similar to as discussed with respect to FIGS. 9-11, the panel 10 may include two ballistic resistant layers 68, three ballistic resistant layers 68, and/or other suitable numbers of ballistic resistant layers, as desired.

FIGS. 17-22 depict the panel system 2 with panels 10 similar to that depicted in FIGS. 12-16, where the panel system 2 is secured relative to a surface of a wall panel 23 of the wall system 14 in the interior space 52 defined by the wall system 14 and includes a first panel 10*a* (e.g., a first sub-panel) and a second panel 10*b* (e.g., a second sub-panel). Although the panel system 2 is depicted as being located in a corner of the wall system 14, this is not required and the panel system 2 may be located along additional and/or alternative portions of the wall system 14. As depicted in FIGS. 17-21, the panels 10 may be configured as movable ballistic resistant slider panels.

Figure 17:
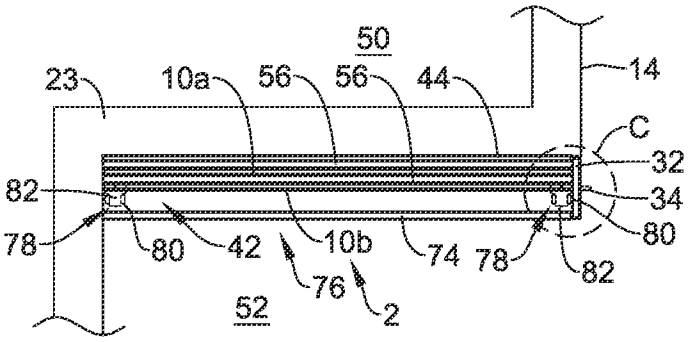
FIG. 17 is a schematic plan view of an illustrative ballistic resistant panel system with a wall system.
Figure 18:
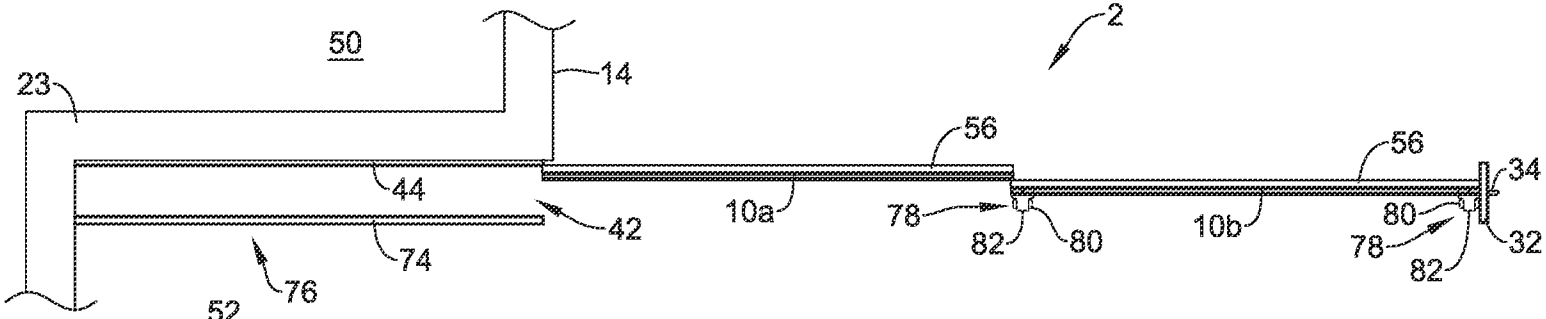
FIG. 18 is a schematic plan view of the illustrative ballistic resistant panel system depicted in FIG. 17, the illustrative ballistic slide panel is in an opened position.

FIG. 17 depicts the panels 10 in a closed position. FIG. 18 depicts the panels 10 in an opened and/or protection position. Although the opened position is described as being the protecting position of the panel 10, it is contemplated that the closed position of the panel 10 may also or alternatively be a protecting position.

The panels 10 may have any suitable dimensions. For example, the panels 10 may be configured to at least partially block an opening in a wall structure when in the opened position and fit at least partially within or along a wall system and/or housing when in the closed position, but this is not required.

As depicted in FIGS. 17 and 18, the second panel 10*b* may be connected to the end panel 32, and the handle 34 may be connected to one or both of the end panel 32 and the second panel 10*b*. The handle 34 may be utilized to facilitate moving one or both of the first panel 10*a* and the second panel 10*b* between the closed position and the fully opened position, as discussed herein.

The panel system 2 depicted in FIGS. 17 and 18 may include one or more housing panels 74 forming a housing 76, where the housing 76 may house the first and second panels 10*a*, 10*b* when the first and second panels 10*a*, 10*b* are in the closed position, may connect to the panel 10, and/or may have an exterior surface facing the interior space 52. The housing panels 74 may take on any suitable configuration for covering the first and second panel 10*a*, 10*b*, for facilitating a connection between the wall system 14 and the panel system 2, and/or for providing decorative and/or functional features in the interior space 52. In some cases, the particular configuration of the housing panels 74 may be at least partially dictated by decorative and/or functional requirements for the interior space 52, but this is not required. The housing panels 74 may be formed from one or more suitable materials for covering the first and second panels 10*a*, 10*b*, for connecting to the first and second panels 10*a*, 10*b*, for connecting to the wall system 14, and/or for one or more other suitable purposes, as discussed herein.

Although not required, when installing the panel system 2 along the wall system 14, one or more ballistic resistant wall panels 44 may be secured to a wall panel of the wall system 14. In one example, the ballistic resistant wall panel 44 may be secured to a wall panel facing the space 50 exterior to the space 52 intended to be protected by the panel system 2, but this is not required.

FIGS. 17 and 18 depict connecting features 56 between the first panel 10*a* and the ballistic resistant wall panel 44, when included as in FIGS. 17 and 18, and/or the wall system 14. Further, connecting features 56 may connect the first panel 10*a* to the second panel 10*b*. As depicted in FIG. 18, the connecting features 56 may facilitate linear movement of the first panel 10*a* and the second panel 10*b* with respect to one another and with respect to the wall system 14. The connecting features 56 and/or other suitable mounts may facilitate other movement of the first and second panels 10*a*, 10*b*, but this is not required.

One or more wheel systems 78 may be connected to the first panel 10*a* and/or the second panel 10*b*. As depicted in FIGS. 17 and 18, the wheel systems 78 may be connected to second panel 10*b* to support the second panel 10*b* when in the opened position and/or to facilitate movement of the first and second panels 10*a*, 10*b*. Although not depicted in the Figures, the first panel 10*a* may include one or more wheel systems 78 and/or other suitable configurations of the panel system 2 may include wheel systems 78 and/or other suitable wheel configurations.

The wheel system 78 may include a wheel 80 and a wheel bracket 82, among other suitable components. The wheel 80 may be configured to facilitate at least linear movement of the second panel 10*b* and support the second panel 10*b* when the second panel 10*b* is in the opened position.

Figure 19:
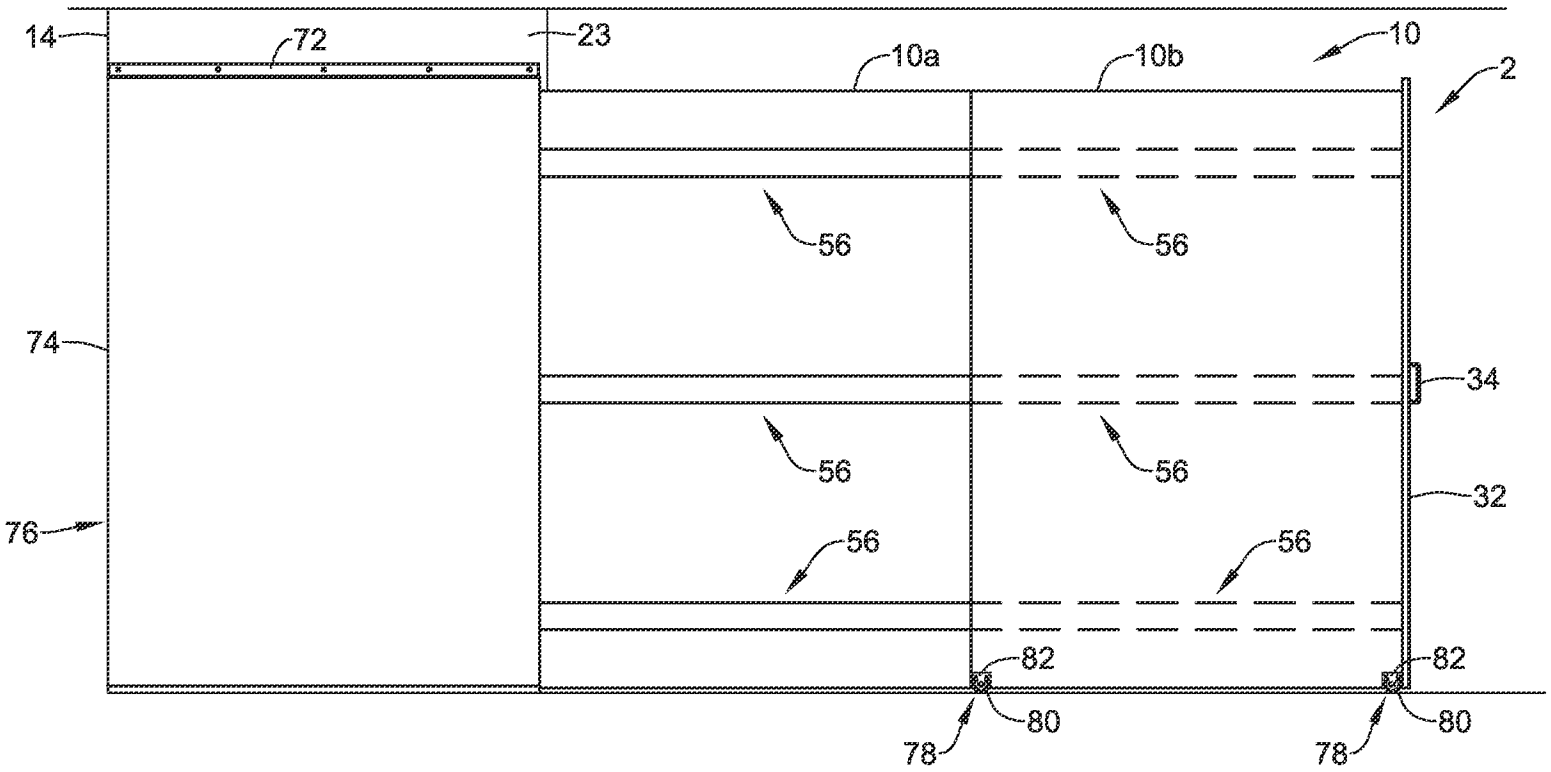
FIG. 19 is a schematic side elevation view of the illustrative ballistic resistant panel system depicted in FIG. 17, the illustrative ballistic panel system is in the opened position.

FIG. 19 depicts a side plan view of the illustrative panel system 2 secured with respect to the wall system 14 extending between the floor 46 and the ceiling 48, where the panels 10 (e.g., the first panel 10*a* and the second panel 10*b*) are in the fully opened position. The connector systems 56 connecting the first panel 10*a* and the second panel 10*b* are depicted in FIG. 19 (e.g., where the connector systems 56 on the second panel 10*b* are shown in broken, phantom lines, but are not viewable in the view depicted in FIG. 19).

The panel system 2 may be secured to the wall system 14 in any suitable manner. As depicted in FIG. 19, the panel system 2 may be secured to the wall system 14 using an attachment angle 72 and one or more fasteners and/or connectors configured to secure the attachment angle 72 to the housing panel 74 and/or the wall system 14. Other suitable configurations are contemplated for securing the panel system 2 to the wall system 14.

Figure 20:
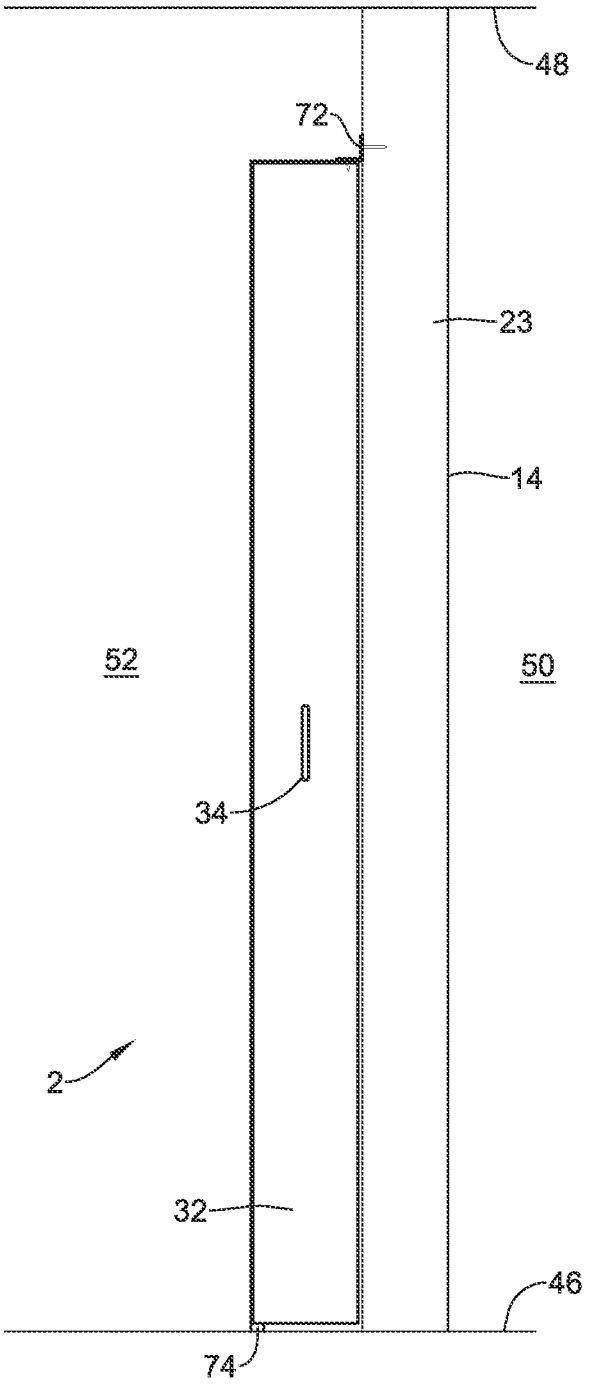
FIG. 20 is a schematic front elevation view of the illustrative ballistic resistant slide panel depicted in FIG. 17.

FIG. 20 depicts an illustrative end view of the panel system 2 secured to a surface of the wall system 14 extending between the floor 46 and the ceiling 48. As depicted in FIG. 20, the end panel 32 of the panel system 2 may extend beyond an opening between the housing panel 74 and the wall system 14 that receives at least portion of the panel system 2 (e.g., a portion of the panels 10). Alternatively or additionally, at least a portion of the end panel 32 may be configured to fit within the opening between the housing panel 74 and the wall system 14 so as to have a surface flush with an outer surface of the wall system 14 and/or the housing panel 74 when the panel system 2 is in the closed position.

Figure 21:
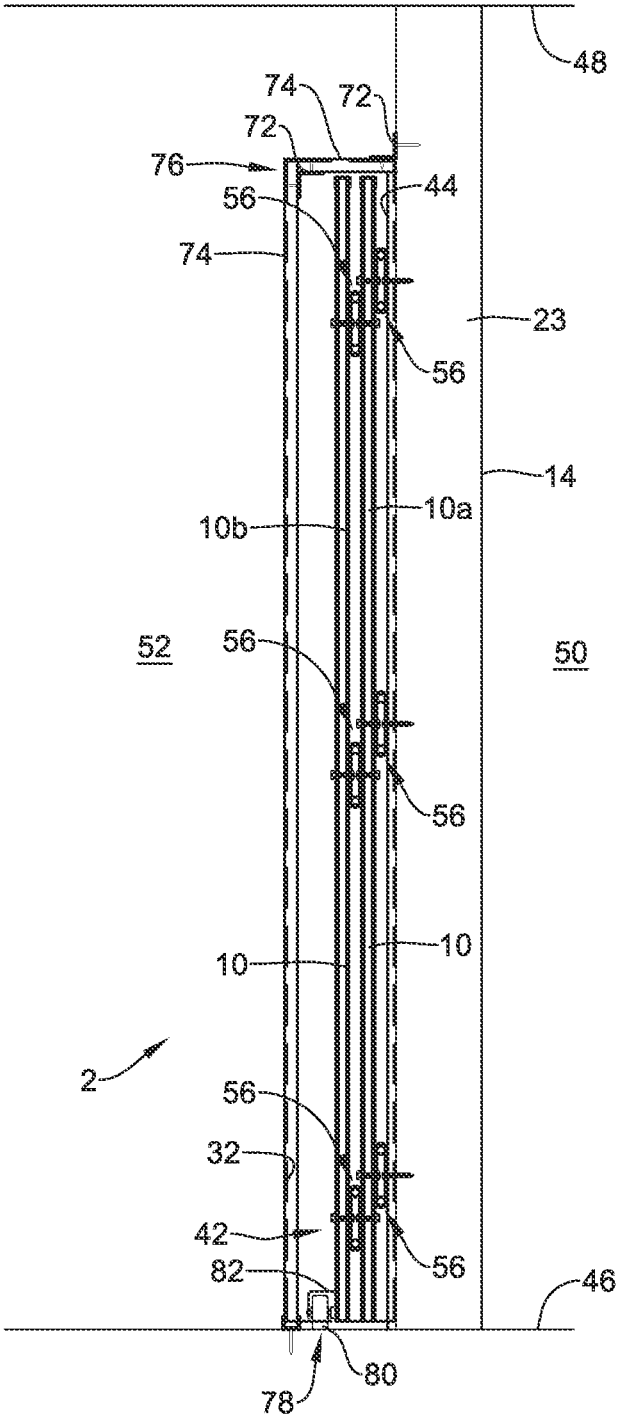
FIG. 21 is a schematic front elevation view of the illustrative ballistic resistant panel system depicted in FIG. 17, with an end panel removed.

FIG. 21 depicts an illustrative end view of the panel system 2 secured along the wall system 14 extending between the floor 46 and the ceiling 48, where the end panel 32 (shown in broken lines) of the panel system 2 is removed to depict the gap 42 between wall system 14 and the housing panel 74. As depicted in FIG. 21, the first panel 10*a* may be connected to the wall system 14 (e.g., via the ballistic resistant wall panel 44) with one or more of the connector systems 56, as discussed herein. As depicted in FIG. 21, the panel system 2 may include three (3) connector systems 56 per panel 10, but other suitable numbers of connector systems 56 may be utilized as needed to support the panels 10 in the closed position, the opened position, and during movement therebetween.

Although the connector system 56 is depicted as being secured to the wall system 14 and the panels 10 using screws, nuts, and bolts, other connector components may be utilized as desired. Further, although the screws, nuts, and bolts are viewable in FIG. 21 for descriptive purposes, these components may not be viewable from the view depicted in FIG. 21.

Similar to as depicted in FIG. 15, FIG. 21 depicts an attachment angle 72 extending between housing panels 74. In some cases, the attachment angle 72 may be secured to adjacent housing panels 74 to support and stabilize the housing 76, but this is not required. The attachment angle 72 may be secured to the housing panels 74 in any suitable manner, including those discussed herein.

Figure 22:
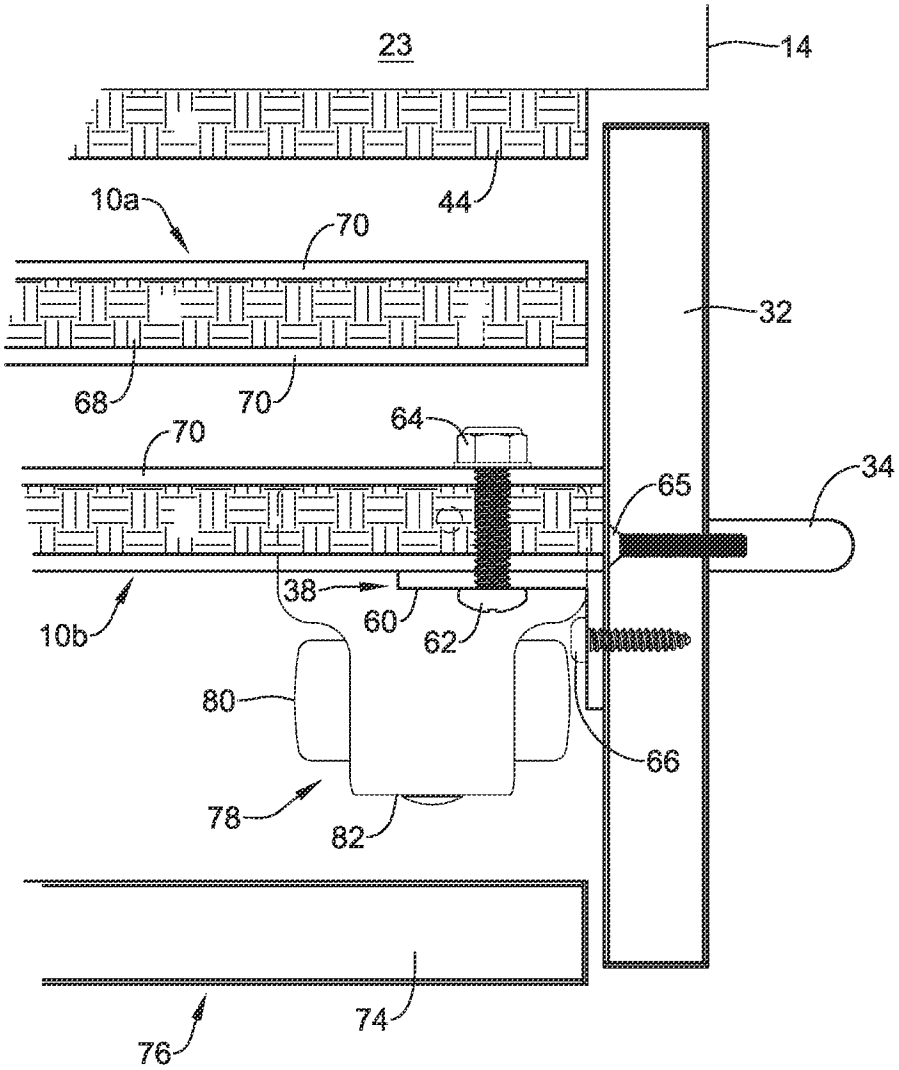
FIG. 22 is a schematic detail sectional view of the illustrative ballistic resistant panel system depicted in FIG. 17, taken from circle C in FIG. 17.

FIG. 22 depicts details of the illustrative connections between the panel 10 (e.g., the second panel 10*b*), the end panel 32, and the handle 34, along with an illustrative configuration of the panels 10 (e.g., the first panel 10*a* and the second panel 10*b*). Although portions of screws, nuts, and/or bolts are depicted in FIG. 22 for descriptive purposes, certain portions of the depicted screws, nuts, and/or bolts depicted may not be viewable from the view of FIG. 22.

As depicted in FIG. 22, the connector 38 may include the bracket 60, the bolt 62 and the nut 64 connecting the bracket 60 to the panel 10, and the screw 66 connecting the bracket 60 to the end panel 32. Further, a screw 65 may be utilized to connect the handle 34 to the end panel 32, but other connector configurations and/or components are contemplated.

As depicted FIG. 22, the first panel 10*a* and/or the second panel 10*b* may be configured from the ballistic resistant layer 68 (e.g., formed from the ballistic resistant material 30 and/or other suitable ballistic resistant core material), an outer layer 70 along one surface of the ballistic resistant layer 68, and another outer layer 70 along another surface of the ballistic resistant layer 68. When connected to the bracket 60, the bolt 62 may extend through one or more of the outer layer(s) 70 and the ballistic resistant layer 68 and connected to the nut 64 to create a tight connection between the panel 10 and the bracket 60. Similar to as discussed with respect to FIGS. 9-11, the first panel 10*a* and/or the second panel 10*b* may include two ballistic resistant layers 68, three ballistic resistant layers 68, and/or other suitable numbers of ballistic resistant layers, as desired.

FIGS. 23-28 schematically depict the panel system 2 with a plurality of panels 10 connected to one another. The plurality of panels 10 may be stored in a closed position within the housing 76 at least partially defined by the housing panels 74 and used in an opened position to divide a space or a room 88 into at least two spaces and/or protect the room 88 or portion of the room 88 from an attacker, a security risk, a weather risk, etc.

Figures 23, 24, 25:
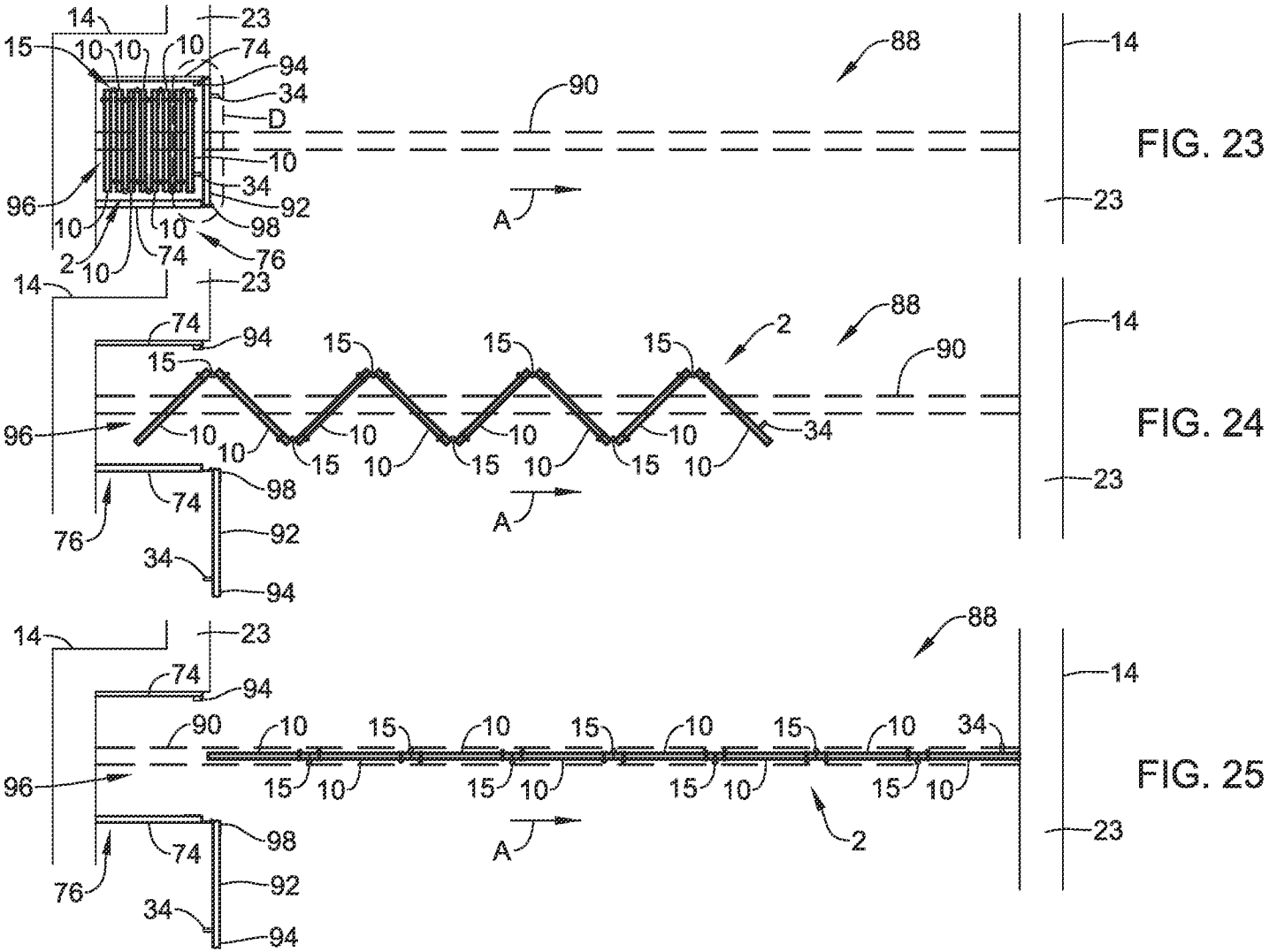
FIG. 23 is a schematic plan view of an illustrative ballistic resistant panel system with a wall system, the illustrative ballistic resistant panel system is in a fully closed position.
FIG. 24 is a schematic plan view of the illustrative ballistic resistant panel system depicted in FIG. 23, the illustrative ballistic panel system is in a partially opened position.
FIG. 25 is a schematic plan view of the illustrative ballistic resistant panel system depicted in FIG. 23, the illustrative ballistic panel system is in a fully opened position.

The housing 76 may be at least partially (e.g., as depicted in FIGS. 23-25) or entirely defined by the housing panels 74 discussed herein. In some cases, the housing 76 may be at least partially defined by the wall system 10, but this is not required. Further, the housing 76 may include one or more doors 92.

The door(s) 92 may include, and/or have attached thereto, one or more handles 34. Applying a force to the handle 34 may facilitate opening or closing the door(s) 92. The handle 34 may be utilized to facilitate moving the door(s) 92 between a closed position and an opened position. In one example, a force may be applied to the handle 34 in a direction that is at least partially in a desired direction of movement of the door(s) 92 to cause movement of the door(s) 92 in the desired direction.

The panels 10 may be connected to one another via mounts 15 and/or other suitable connectors. In some cases, the mounts 15 may be hinges and/or other suitable mounts configured to allow the panels to pivot with respect to an adjacent panel 10. When in an opened position and to facilitate moving the panels between closed and opened positions, the panels 10 may slide along a ceiling track 90 (shown in broken, phantom lines for descriptive purposes), a floor track, and/or other guide. Alternatively or additionally to the mounts 15 being hinges, the panels 10 may be connected using slide system connectors (e.g., the connectors 56 and/or other suitable slide systems), flexible tape or fabric, etc.

The panels 10 may have any suitable dimensions. For example, the panels 10 may be configured to, when used together, at least divide the room 88 into two or more spaces. In one example, the panels 10 may have dimension suitable for extending across the room 88 from the housing 76 or a first wall panel 23 of the wall system 14 to a second wall panel 23 of the wall system 14 spaced from the housing 76 and/or the first wall panel 23, but this is not required.

The panel(s) 10 may include, and/or may have attached thereto, one or more handles 34. Applying a force to the handle 34 may facilitate opening and/or closing the panels 10. The handle 34 may be utilized to facilitate moving the panels 10 between a closed position and an opened position. In one example, a force may be applied to the handle 34 in a direction that is at least partially in a desired direction of movement of the panels 10 to cause movement of the panels 10 in the desired direction. In one example of a handle 34 configuration in the panels 10 of the panel system 2 depicted in FIGS. 23-28, the handle 34 may extend from an outer surface of a lead panel 10 and applying a force on the panels 10 at least partially in the general direction of arrow A (e.g., a direction substantially parallel to a length of the ceiling track 90) may cause movement of the panels 10 in the direction of arrow A. Other configurations and/or locations of the handle 34 with respect to the panels 10 are contemplated.

As depicted in FIG. 23, the panels 10 are located in an interior space 66 within the housing 76 with the door 92 closed and engaging a door catch 94 (e.g., any suitable door catching structure, such as a latch, magnet, etc., located on the wall system 14, the door panels 74, the door 92, and/or located elsewhere and configured to engage a door in a closed position, which may or may not include or be used with a suitable lock) such that the panels 10 are in a fully closed position. The panels 10 may be stored in the position depicted in FIG. 23 when they are not needed for dividing the room 88 and/or securing a portion of the room 88 from an attacker or attack, security risk, weather risk, etc.

FIG. 24 depicts the panels 10 of the panel system 2 in an opened position between a fully closed position and a fully opened position. When moving the panels 10 to the opened position, the door 92 may be opened and pivoted about one or more door hinges 98 such that the panels 10 may be removed from the interior space 96 within the housing 76. To adjust the panel system 2 to an opened position, a force at least partially in the direction of arrow A may be applied to the handle 34 attached to or on a lead or front panel 10, such that the panels 10 pivot about the mounts 115 and are pulled out of the housing 76 along the ceiling track 90 or other suitable track. Other techniques for removing the panels 10 from the housing 76 and/or guiding the panels 10 to the opened position are contemplated.

FIG. 25 depicts the panels 10 of the panel system 2 in the fully opened position extending across the room 88. Although not depicted, when in the fully opened position, the panels 10 may be locked in place using one or more lock components. Example lock components include, but are not limited to, floor bolts (e.g., the floor bolt 16 and/or other suitable floor bolts), ceiling bolts, pad locks, cam locks, knob locks, deadbolts, mortise locks, etc.

To adjust the panels 10 of the panel system 2 from the fully opened position to the closed position, the actions depicted in and/or described with respect to FIGS. 23-25 may be substantially reversed. For example, applying a force to the handle 34 on or extending from the panel 10 at least partially in a direction substantially opposite of the direction of arrow A may cause the panels to pivot about the mounts 15 and move toward the housing 76.

Figure 26:
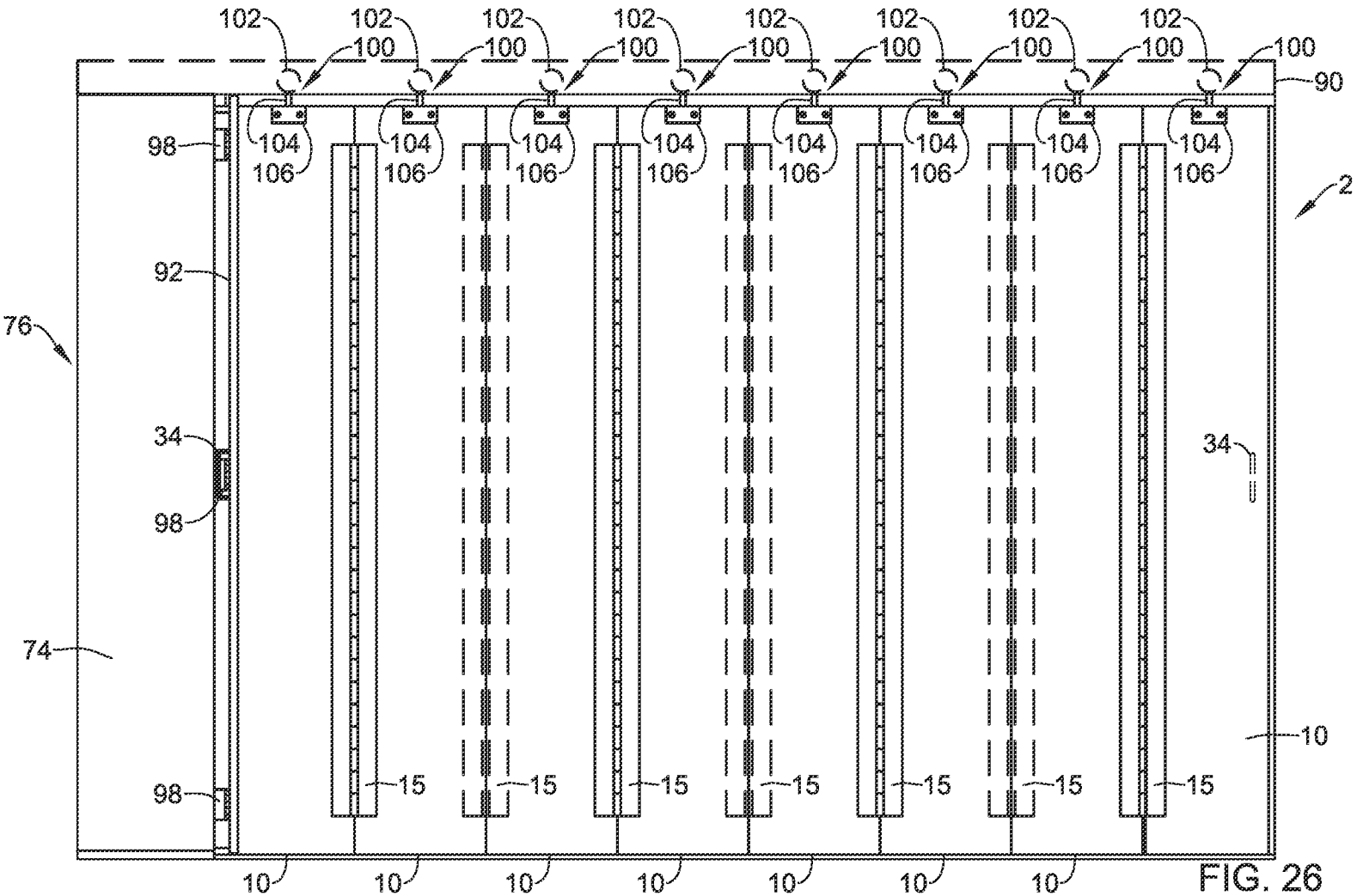
FIG. 26 is a schematic side elevation view of the illustrative ballistic resistant panel system depicted in FIG. 25, the illustrative ballistic panel system is in the fully opened position.

FIG. 26 schematically depicts a side plan view of the illustrative panel system 2 in the fully opened position extending out of the housing 76 with the door 92 pivoted open about the door hinges 98. The handle 34 on the panel 10 and every other mount 15 (e.g., a continuous hinge, as depicted, and/or other suitable mount) are depicted in broken, phantom lines for descriptive purposes.

In some cases, one or more of the panels 10 of the panel system 2 may include an engagement system 100 configured to engage the ceiling track 90 (shown in broken, phantom lines for descriptive purposes as the ceiling track may be hidden from view within the space 88) and/or other suitable tracks. Example engagement systems 100 include, but are not limited to, roller systems, slider systems, etc. As depicted in FIG. 26, the engagement system 100 may be a roller system having one or more rollers or wheels 102 connected to an attachment bar 104 connected to a bracket 106 secured to an associated panel 10. The bracket 106 may be secured to the associated panel 10 in any suitable manner including, but not limited to, a screw connection, an adhesive connection, and/or other suitable connection. Such a configuration of the engagement system 100 and the ceiling track 90 may facilitate using ballistic resistant materials in the panel system 2 due to the weight of such materials.

In operation, the rollers or wheels 102 are configured to travel linearly along the ceiling track 90 and the panels 10 are configured to pivot with respect to the rollers or wheels 102. To facilitate the linear movement of the rollers or wheels 102 and the pivoting of the panels 10, the attachment bar 104 may be configured to pivot with respect to one of the roller or wheel 102 and the panel 10 and secured with respect to the other of the wheel 102 and the panel. In one example, the attachment bar 104 may be secured with respect to the panel 10 and configured to pivot with respect to the wheel 102, but this configuration is not required. Alternatively, the roller or wheel 102 may be secured relative to the panel 10 and the roller or wheel 102 may be configured to pivot within the ceiling track 90 and/or other suitable track.

Figure 27:
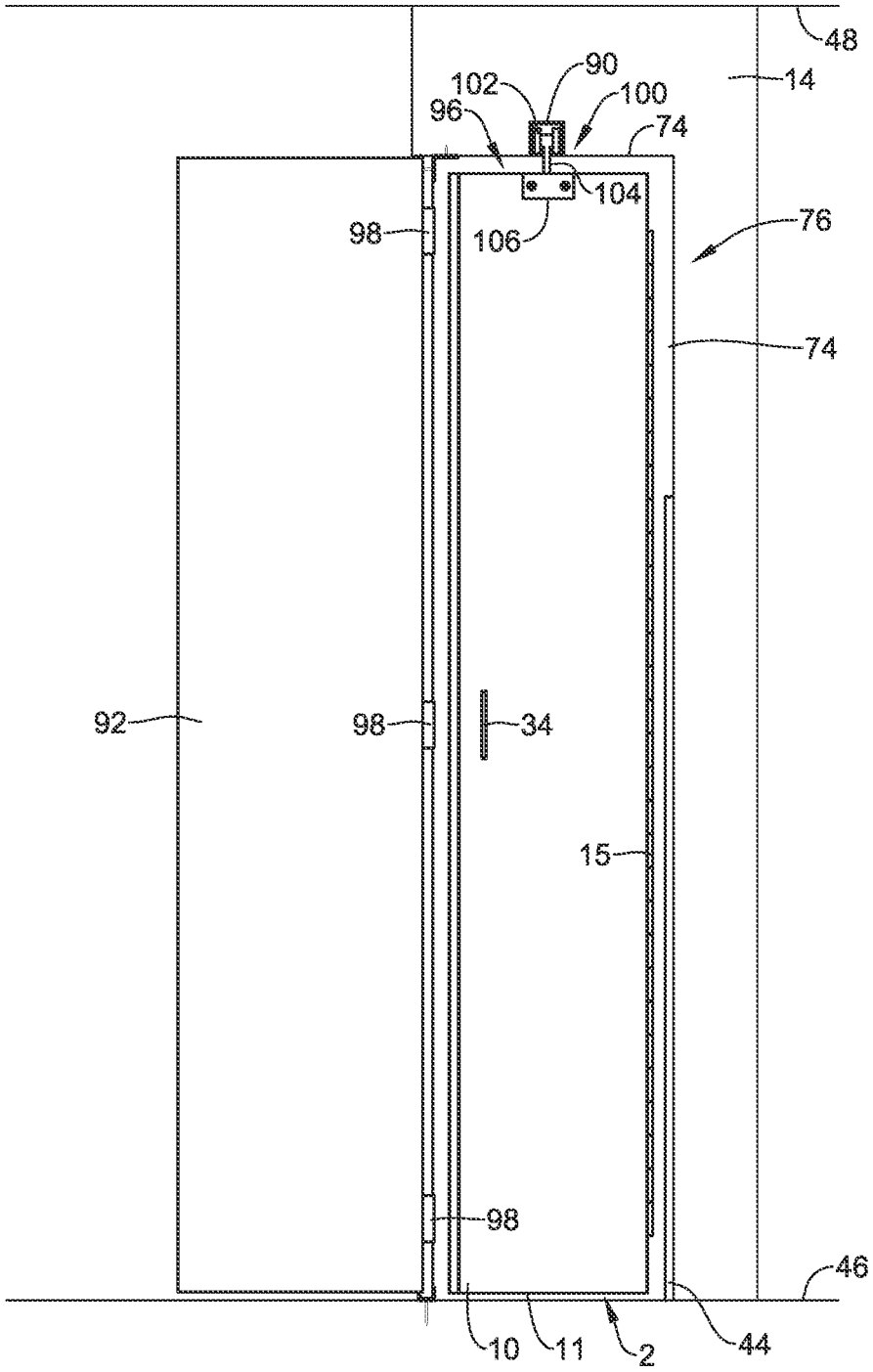
FIG. 27 is a schematic front elevation view of the illustrative ballistic resistant panel system depicted in FIG. 23, with a door opened.

FIG. 27 schematically depicts an illustrative end view of the panel system 2 in a closed position within the interior space 96 of the housing 76, where the door 92 is in the opened position. When the panel system 2 is in a closed configuration, the wheels 102 of the engagement systems 100 may be positioned adjacent one another in the ceiling track 90 (e.g., a U or C shaped channel and/or other suitable track) with the panels 10 rotated to fit within the housing opening 96 in the housing 76. As shown in FIG. 27, a ballistic resistant panel 44 has been positioned and/or secured within the housing 96.

The panels 10 may be connected to the track 90 in a manner that leaves a space between a bottom edge 11 of the panels 10 and the floor 46. In other suitable configurations, the panels 10 may extend to the floor 46, the panels 10 may include an engagement system configured to engage a floor track, and/or the panels 10 may include one or more other features to facilitate movement of the panels 10 between opened and closed positions and protect a space in the room 88 from one or more risks.

Figure 28:
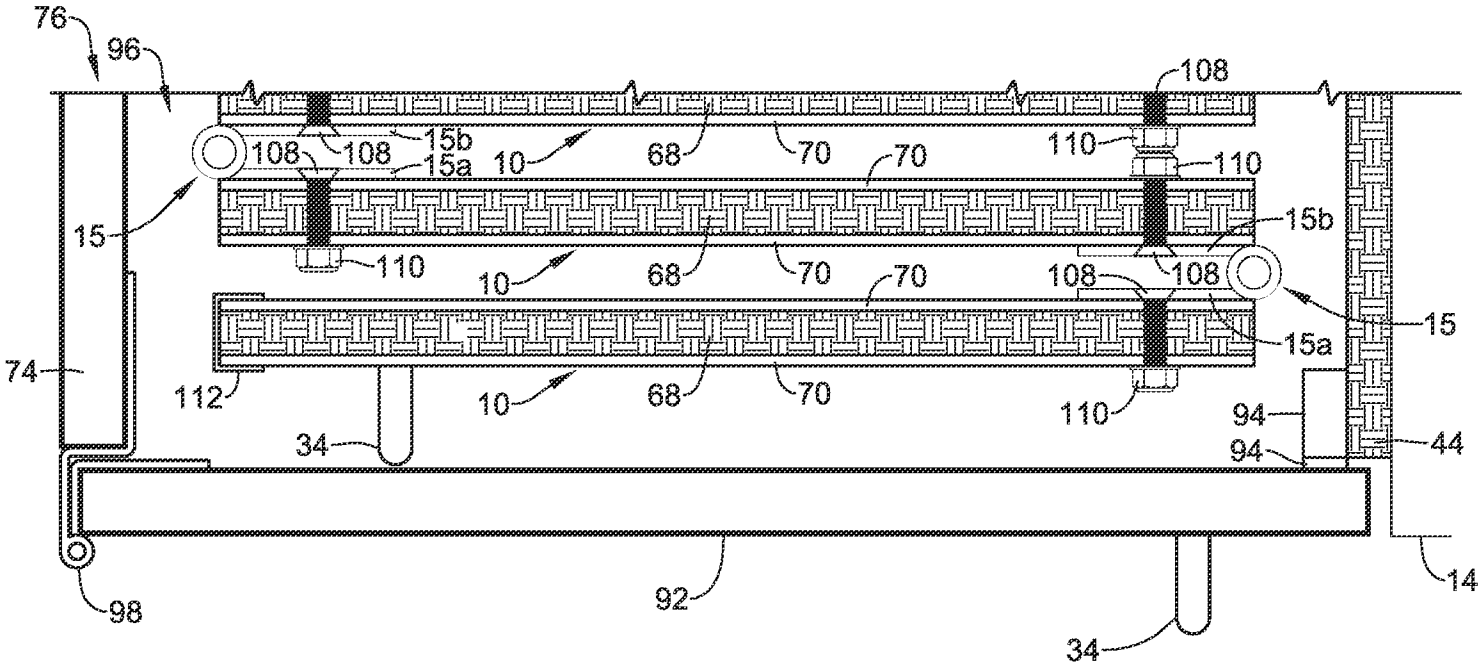
FIG. 28 is a schematic detail sectional view of the illustrative ballistic resistant panel system depicted in FIG. 23, taken from circle D in FIG. 23.

FIG. 28 schematically depicts sectional details of the illustrative connections between the panels 10, along with an illustrative configuration of the panels 10. Although portions of screws and/or nuts are depicted in FIG. 28 for descriptive purposes, certain portions of the depicted screws and/or nuts depicted may not be viewable from the view of FIG. 28.

As depicted in FIG. 28, the mounts 15 may have a first portion 15*a* secured or otherwise connected to the panels 10 with a screw 108 extending through the panel 10 and a nut 110 engaging the screw 108 and a second portion 15*b* similarly secured to an adjacent panel 10. The mounts 15 may have a hinge configuration and may be continuous hinges extending at least a majority of a height of the panels 10, but this is not required. When the mount 15 is or includes a continuous hinge, the mount 15 may be connected to the panels 10 at two or more locations in the manner discussed herein. Other suitable mounts 15 are contemplated and other suitable mount features for mounting the mounts 15 are contemplated.

As depicted FIG. 28, the panels 10 may be configured from the ballistic resistant layer 68 (e.g., formed from the ballistic resistant material 30 and/or other suitable ballistic resistant core material), an outer layer 70 along one surface of the ballistic resistant layer 68, and another outer layer 70 along another surface of the ballistic resistant layer 68. When connected to the mount 15, the screw 108 may extend through one or more of the outer layer(s) 70 and the ballistic resistant layer 68 and connected to the nut 110 to create a tight connection between the panel 10 and the mount 15. Similar to as discussed with respect to FIGS. 9-11, the panels 10 may include two ballistic resistant layers 68, three ballistic resistant layers 68, and/or other suitable numbers of ballistic resistant layers, as desired.

In one example use of the panel system 2, the panel(s) 10 may be in the closed position (e.g., within a housing and/or in a functional or decorative position within a space). An attacker risk may be identified (e.g., a known attacker identified and/or an expected attacker identified) at one or more locations along a wall system (e.g., the wall system 14 and/or other suitable wall system). The attacker risk may be identified in any suitable manner including, but not limited to, an alarm, an alert, a mobile device update/alert/alarm, a news story, an eye witness, etc. In response to identifying the attacker risk, a position of the panel(s) 10 may be adjusted from a non-securing position (e.g., a closed position) spaced from one or more locations along the wall system or between wall systems through which an attacker may be expected to attack to a securing position (e.g., an opened position) covering the one or more locations along the wall system or between the wall systems through which the attacker may be expected to attack a space. In some cases, the panel(s) 10 may be locked in the securing position, but this is not required.

Further, when the panel system 2 is not in-use securing a room and/or at other suitable times, one or more outer surfaces thereof may be functional surfaces with which users may interact. In one example, an outer surface of the panel system 2 (e.g., an outer surface of the panel 10 and/or other suitable surfaces) may be a white board with which a user may be able to interact by drawing and/or writing thereon.

Those skilled in the art will recognize that the present disclosure may be manifested in a variety of forms other than the specific embodiments described and contemplated herein. For instance, as described herein, various embodiments include one or more modules described as performing various functions. However, other embodiments may include additional modules that split the described functions up over more modules than that described herein. Additionally, other embodiments may consolidate the described functions into fewer modules.

Although various features may have been described with respect to less than all embodiments, this disclosure contemplates that those features may be included on any embodiment. Further, although the embodiments described herein may have omitted some combinations of the various described features, this disclosure contemplates embodiments that include any combination of each described feature. Accordingly, departure in form and detail may be made without departing from the scope and spirit of the present disclosure as described in the appended claims.

What is claimed is:

1. A ballistic resistant panel system comprising:

a panel, the panel comprising:

a ballistic resistant layer; and an outer layer secured to at least one side of the ballistic resistant layer;

an end panel secured to an end of the panel and configured to house the panel; and a mount connected to the panel and configured to secure the panel with respect to a wall system and facilitate selective movement of the panel relative to the wall system.

2. The ballistic resistant panel system of claim 1, further comprising:

a lock secured to the panel and configured to lock the panel at a location relative to the wall system.

3. The ballistic resistant panel system of claim 1, further comprising:

one or more wheels secured to the panel to facilitate the movement of the panel relative to the wall system.

4. The ballistic resistant panel system of claim 1, further comprising:

one or more slide systems secured to the panel and configured to facilitate the movement of the panel relative to the wall system.

5. The ballistic resistant panel system of claim 1, wherein the panel comprises:

a first sub-panel, wherein the ballistic resistant layer is a first ballistic resistant layer of the first sub-panel and the outer layer is a first outer layer of the first sub-panel;

a second sub-panel, the second sub-panel comprising:

a second ballistic resistant layer of a second sub-panel;

a second outer layer of the second sub-panel, the second outer layer is secured to the second ballistic resistant layer.

6. The ballistic resistant panel system of claim 5, wherein:

the second sub-panel is movable with respect to the first sub-panel; and the first sub-panel and the second sub-panel are movable with respect to the wall system.

7. The ballistic resistant panel system of claim 5, further comprising:

a slide system connected to the first sub-panel and the second sub-panel, the slide system is configured to facilitate movement between the first sub-panel and the second sub-panel.

8. The ballistic resistant panel system of claim 1, further comprising:

a housing configured to at least partially house the panel when the panel is in a closed position.

9. The ballistic resistant panel system of claim 1, wherein the movement is one or both of rotational movement and linear movement.

10. The ballistic resistant panel system of claim 1, wherein the ballistic resistant layer comprises two or more ballistic resistant panels secured relative to one another.

11. A ballistic resistant panel system comprising:

a panel, the panel comprising:

a ballistic resistant layer; and an outer layer secured to at least one side of the ballistic resistant layer;

an end panel secured relative to the panel and having a width that is perpendicular to a width of the panel;

a housing; and wherein the panel is movable relative to the housing from a closed position to an opened position and the end panel is configured to house the panel when the panel is in the closed position.

12. The ballistic resistant panel system of claim 11, further comprising:

a handle secured relative to the panel; and wherein the panel is movable from the closed position to the opened position in response to a force applied to the handle, the force is at least partially in a direction of the movement.

13. The ballistic resistant panel system of claim 11, further comprising:

a handle secured to the end panel.

14. The ballistic resistant panel system of claim 11, wherein the panel is a pocket door and the housing includes the end panel secured to the panel.

15. The ballistic resistant panel system of claim 11, wherein:

the housing includes a backer layer between the panel and a wall of a wall system; and the outer layer includes one or both of a functional portion and a decorative portion.

16. A method of securing an opening in a wall system, the method comprising:

identifying an attacker risk at one or more locations along a wall system; and adjusting a position of a ballistic resistant panel from a non-securing position spaced from the one or more locations along the wall system to a securing position covering the one or more locations along the wall system by applying a force to an end panel secured relative to the ballistic resistant panel and having a width that is transverse to a width of the ballistic resistant panel, the end panel is configured to house the ballistic resistant panel.

17. The method of claim 16, further comprising:

locking the ballistic resistant panel in the securing position.

18. The method of claim 16, further comprising:

interacting with an outer surface of the ballistic resistant panel when the ballistic resistant panel is in the non-securing position.

19. A ballistic resistant panel system comprising:

a panel, the panel comprising:

a ballistic resistant layer; and an outer layer secured to at least one side of the ballistic resistant layer;

a housing; and wherein the panel is movable relative to the housing from a closed position to an opened position, and wherein the panel is a pocket door and the housing includes an end panel secured to an end of the panel and configured to house the panel when the panel is in the closed position.

* * * * *